US009558626B2

(12) United States Patent
Decasa, Jr. et al.

(10) Patent No.: US 9,558,626 B2
(45) Date of Patent: Jan. 31, 2017

(54) GAMING SYSTEM AND METHOD PROVIDING A GROUP GAME HAVING MULTIPLE STAGES

(71) Applicant: IGT, Las Vegas, NV (US)

(72) Inventors: Rogelio S. Decasa, Jr., Reno, NV (US); Kevin N. Taylor, Reno, NV (US)

(73) Assignee: IGT, Las Vegas, NV (US)

( * ) Notice: Subject to any disclaimer, the term of this patent is extended or adjusted under 35 U.S.C. 154(b) by 357 days.

(21) Appl. No.: 14/027,911

(22) Filed: Sep. 16, 2013

(65) Prior Publication Data

US 2015/0080108 A1 Mar. 19, 2015

(51) Int. Cl.
*G07F 17/32* (2006.01)

(52) U.S. Cl.
CPC ..... *G07F 17/3244* (2013.01); *G07F 17/323* (2013.01); *G07F 17/3274* (2013.01)

(58) Field of Classification Search
CPC ..... G07F 17/3272; G07F 17/3276; G07F 17/3258; F07F 17/3262; F07F 17/3244
See application file for complete search history.

(56) References Cited

U.S. PATENT DOCUMENTS 6,113,492 A 9/2000 Walker et al.
6,174,235 B1 1/2001 Walker et al.
6,217,448 B1 4/2001 Olsen
6,238,288 B1 5/2001 Walker et al.
6,309,300 B1 10/2001 Glavich
6,315,664 B1 11/2001 Baerlocher et al.
6,319,124 B1 11/2001 Baerlocher et al.
6,328,649 B1 12/2001 Randall et al.
6,364,767 B1 4/2002 Brossard et al.
6,406,369 B1 6/2002 Baerlocher et al.
6,425,824 B1 7/2002 Baerlocher et al.
6,439,995 B1 8/2002 Hughs-Baird et al.
6,450,883 B1 9/2002 O'Halloran
6,468,156 B1 10/2002 Hughs-Baird et al.
6,511,375 B1 1/2003 Kaminkow
6,514,141 B1 2/2003 Kaminkow et al.
6,561,889 B1 5/2003 Xu et al.
6,569,013 B1 5/2003 Taylor
6,582,306 B1 6/2003 Kaminkow
6,582,307 B2 6/2003 Webb
(Continued)

OTHER PUBLICATIONS

Breakfast at Tiffany's Multi-Level Progressives Advertisement, copyright IGT 2011 (2 pages).
(Continued)

*Primary Examiner* — Omkar Deodhar
(74) *Attorney, Agent, or Firm* — Nealm Gerber & Eisenberg LLP

(57) ABSTRACT

Various embodiments of the present disclosure provide a gaming system and method providing a group game having a same average expected total payback percentage regardless of the number of players participating in the group game. In various embodiments, the gaming system determines or sets one or more characteristics, features, or parameters of the group game based on the number of players participating in the group game such that the average expected total payback percentage of the group game is the same or substantially the same for each play of the group game regardless of the number of players participating in that play of the group game.

20 Claims, 21 Drawing Sheets

(56) References Cited

U.S. PATENT DOCUMENTS 6,599,185 B1 7/2003 Kaminkow et al.
6,602,137 B2 8/2003 Kaminkow et al.
6,609,971 B2 8/2003 Vancura
6,676,516 B2 1/2004 Baerlocher et al.
6,712,693 B1 3/2004 Hettinger
6,733,386 B2 5/2004 Cuddy et al.
6,746,016 B2 6/2004 Perrie et al.
6,769,983 B2 8/2004 Slomiany
6,780,107 B2 8/2004 Baerlocher et al.
6,783,457 B2 8/2004 Hughs-Baird et al.
6,802,778 B1 10/2004 Lemay et al.
6,817,944 B2 11/2004 Kaminkow et al.
6,837,793 B2 1/2005 McClintic
6,840,856 B2 1/2005 Stern
6,869,361 B2 3/2005 Sharpless et al.
6,875,108 B1 4/2005 Hughs-Baird
6,877,745 B1 4/2005 Walker et al.
6,899,620 B2 5/2005 Kaminkow et al.
6,902,478 B2 6/2005 McClintic
6,918,834 B2 7/2005 Vancura
6,932,702 B1 8/2005 Harris
6,958,013 B2 10/2005 Miereau et al.
7,004,834 B2 2/2006 Walker et al.
7,029,395 B1 4/2006 Baerlocher
7,037,191 B2 5/2006 Rodgers et al.
7,040,984 B2 5/2006 Mead
7,070,505 B2 7/2006 Vancura et al.
7,077,744 B2 7/2006 Cannon
7,081,050 B2 7/2006 Tarantino
7,121,942 B2 10/2006 Baerlocher
7,169,041 B2 1/2007 Tessmer et al.
7,172,506 B2 2/2007 Baerlocher et al.
7,198,569 B2 4/2007 Wolf et al.
7,201,657 B2 4/2007 Baerlocher et al.
7,235,011 B2 6/2007 Randall et al.
7,264,545 B2 9/2007 Maya et al.
7,273,415 B2 9/2007 Cregan et al.
7,300,348 B2 11/2007 Kaminkow et al.
7,314,408 B2 1/2008 Cannon
7,314,409 B2 1/2008 Maya et al.
7,316,609 B2 1/2008 Dunn et al.
7,361,087 B2 4/2008 Baerlocher et al.
7,361,088 B2 4/2008 Maya et al.
7,371,174 B2 5/2008 Baerlocher
7,393,280 B2 7/2008 Cannon
7,413,510 B2 8/2008 Schlegel et al.
7,427,236 B2 9/2008 Kaminkow et al.
7,452,272 B2 11/2008 Walker et al.
7,500,915 B2 3/2009 Wolf et al.
7,544,129 B2 6/2009 Baerlocher
7,547,252 B2 6/2009 Peterson et al.
7,563,167 B2 7/2009 Walker et al.
7,566,271 B2 7/2009 Hostetler et al.
7,585,218 B2 9/2009 Mead et al.
7,588,496 B2 9/2009 Van Asdale
7,591,722 B2 9/2009 Baerlocher et al.
7,597,621 B2 10/2009 Baerlocher
7,651,392 B2 1/2010 Pennington et al.
7,682,248 B2 3/2010 Baerlocher et al.
7,690,981 B2 4/2010 Ching et al.
7,740,534 B2 6/2010 Walker et al.
7,749,070 B2 7/2010 Baerlocher et al.
7,753,782 B2 7/2010 Cuddy et al.
7,771,274 B2 8/2010 Walker et al.
7,785,188 B2 8/2010 Cannon
7,789,755 B2 9/2010 Davis et al.
7,806,760 B2 10/2010 Baerlocher
7,819,745 B2 10/2010 Cuddy et al.
7,828,648 B2 11/2010 Jackson
7,828,649 B2 11/2010 Cuddy et al.
7,857,699 B2 12/2010 Baerlocher
7,883,403 B2 2/2011 Low et al.
7,887,409 B2 2/2011 Baerlocher et al.
7,892,093 B2 2/2011 Kniesteadt et al.
7,963,847 B2 6/2011 Baerlocher
8,002,621 B2 8/2011 Mattice et al.
8,021,222 B2 9/2011 Walker et al.
8,021,230 B2 9/2011 Baerlocher et al.
8,029,355 B2 10/2011 Parente
8,033,912 B2 10/2011 Cannon
8,043,153 B2 10/2011 Ross et al.
8,070,587 B2 12/2011 Davis et al.
8,070,593 B2 12/2011 DeWaal et al.
8,079,903 B2 12/2011 Nicely et al.
8,087,999 B2 1/2012 Oberberger et al.
8,092,297 B2 1/2012 Decasa et al.
8,105,149 B2 1/2012 DeWaal
8,109,821 B2 2/2012 Kovacs et al.
8,117,633 B2 2/2012 Kurosawa
8,118,662 B2 2/2012 Caputo et al.
8,118,666 B2 2/2012 Nicely et al.
8,133,105 B2 3/2012 Walker et al.
8,210,935 B2 7/2012 Caputo et al.
8,216,065 B2 7/2012 Kaminkow et al.
8,221,206 B2 7/2012 Marks et al.
8,231,448 B2 7/2012 Cuddy et al.
8,251,791 B2 8/2012 Baerlocher et al.
8,262,455 B2 9/2012 Caputo et al.
8,287,364 B2 10/2012 Caputo et al.
8,292,720 B2 10/2012 Davis et al.
8,292,723 B2 10/2012 DeWaal
8,308,549 B2 11/2012 Baerlocher et al.
8,313,368 B2 11/2012 Filipour et al.
8,342,947 B2 1/2013 Baerlocher et al.
8,371,938 B2 2/2013 Peterson
8,382,572 B2 2/2013 Hoffman et al.
8,393,968 B2 3/2013 Nicely et al.
8,398,473 B2 3/2013 Baerlocher et al.
8,460,090 B1 6/2013 Gilliland
8,460,093 B2 6/2013 Jackson
8,496,519 B2 7/2013 Hoffman et al.
8,500,548 B2 8/2013 Baerlocher et al.
8,512,147 B2 8/2013 Aoki et al.
2002/0125637 A1* 9/2002 Leis ..... A63F 3/0423 273/272
2003/0125103 A1 7/2003 Tessmer et al.
2005/0054435 A1 3/2005 Rodgers et al.
2005/0208992 A1 9/2005 Randall
2006/0030401 A1 2/2006 Mead et al.
2007/0054732 A1 3/2007 Baerlocher
2008/0113765 A1* 5/2008 DeWaal ..... G07F 17/3244 463/25
2009/0042644 A1 2/2009 Zielinski
2009/0042652 A1 2/2009 Baerlocher et al.
2009/0088239 A1 4/2009 Iddings et al.
2009/0117970 A1 5/2009 De Waal et al.
2009/0124327 A1 5/2009 Caputo et al.
2009/0124362 A1 5/2009 Cuddy et al.
2009/0275411 A1 11/2009 Kisenwether et al.
2010/0120506 A1 5/2010 Davis et al.
2010/0137056 A1 6/2010 Hoffman et al.
2011/0111826 A1 5/2011 Baerlocher et al.
2011/0111827 A1 5/2011 Nicely et al.
2011/0118010 A1 5/2011 Brune
2011/0230251 A1 9/2011 Nicely et al.
2012/0108319 A1 5/2012 Caputo et al.
2012/0202599 A1 8/2012 Cohen
2013/0079076 A1 3/2013 Filipour et al.
2013/0079087 A1 3/2013 Brosnan et al.
2013/0079088 A1 3/2013 Lafky et al.
2013/0079114 A1 3/2013 Nicely et al.
2013/0084941 A1 4/2013 Caputo et al.
2013/0157733 A1 6/2013 Thorne et al.
2013/0172059 A1 7/2013 Nicely et al.
2013/0225268 A1 8/2013 Caputo et al.

OTHER PUBLICATIONS

Game King® Enhanced Video Slots Series Fort Knox Progressives™ Enhanced Video Slots Advertisement, copyright IGT 2004 (4 pages).

* cited by examiner

GAMING SYSTEM AND METHOD PROVIDING A GROUP GAME HAVING MULTIPLE STAGES

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming systems that provide players awards in primary or base games are well known. These gaming systems generally require a player to place a wager to activate a play of the primary game. For many of these gaming systems, any award provided to a player for a wagered-on play of a primary game is based on the player obtaining a winning symbol or a winning symbol combination and on an amount of the wager (e.g., the higher the amount of the wager, the higher the award). Winning symbols or winning symbol combinations that are less likely to occur typically result in larger awards being provided when they do occur.

For such known gaming systems, an amount of a wager placed on a primary game by a player may vary. For instance, a gaming system may enable a player to wager a minimum quantity of credits, such as one credit (e.g., in monetary currency, one penny, nickel, dime, quarter, or dollar, in non-monetary currency, one point, credit, coin, token, free play credit, or virtual buck), up to a maximum quantity of credits, such as five credits. The gaming system may enable the player to place this wager a single time or multiple times for a single play of the primary game. For instance, a gaming system configured to operate a slot game may have one or more paylines, and the gaming system may enable a player to place a wager on each of the paylines for a single play of the slot game. Thus, it is known that a gaming system, such as one configured to operate a slot game, may enable players to place wagers of substantially different amounts on each play of a primary game. For example, the amounts of the wagers may range from one credit up to 125 credits (e.g., five credits on each of twenty-five separate paylines). This is also true for other wagering games, such as video draw poker, in which players can place wagers of one or more credits on each hand, and in which multiple hands can be played simultaneously. Accordingly, it should be appreciated that different players play at substantially different wager amounts or levels and substantially different rates of play.

Bonus or secondary games are also known in gaming systems. Such gaming systems usually provide an award to a player for a play of one such bonus game in addition to any awards provided for any plays of any primary games. Bonus games usually do not require an additional wager to be placed by the player to be initiated. Bonus games are typically initiated or triggered upon an occurrence of a designated triggering symbol or designated triggering symbol combination in the primary game. For instance, a gaming system may initiate or trigger a bonus game when a bonus symbol occurs on the payline on the third reel of a three reel slot machine. The gaming systems generally indicates when a bonus game is initiated or triggered through one or more visual and/or audio output devices, such as the reels, lights, speakers, display screens, etc. Part of the enjoyment and excitement of playing certain gaming systems is the initiation or triggering of a bonus game, even before the player knows an amount of a bonus award won via the bonus game.

Various players continually seek out new and different variations to gaming systems. A continuing need thus exists for gaming systems and methods that provide new, exciting, and engaging games.

SUMMARY

Various embodiments of the present disclosure provide a gaming system and method providing a multiple-stage group game having a same average expected total payback percentage regardless of the number of players participating in the group game. In various embodiments, the gaming system determines or sets one or more characteristics, features, or parameters of the group game based on the number of players participating in the group game such that the average expected total payback percentage of the group game is the same or substantially the same for each play of the group game regardless of the number of players participating in that play of the group game.

In one embodiment, the gaming system initiates a group game having a plurality of different stages and initiates one of the stages of the group game that has not yet been provided. The gaming system displays a plurality of different selections. In this embodiment, the plurality of displayed selections include at least one designated selection. The gaming system displays an award amount associated with the current stage of the group game. For a round of picks, for each of a plurality of gaming machines, the gaming system receives a pick of one of the displayed selections from a player of that gaming machine. The gaming system determines whether a target quantity of the at least one designated selection has been picked during the current stage.

If the target quantity of the at least one designated selection has been picked during the current stage, the gaming system provides the displayed award amount to one or more of the players of the gaming machines. If all of the stages of the group game have been provided, the gaming system ends the group game, but if at least one of the stages of the group game has not yet been provided the gaming system initiates an unplayed stage of the group game. If, on the other hand, the target quantity of the at least one designated selection has not yet been picked during the current stage, the gaming system determines whether a maximum quantity of rounds of picks has been completed during the current stage. If the maximum quantity rounds of picks has been completed during the current stage, the gaming system ends the group game, but if the maximum quantity of rounds of picks has not yet been completed during the current stage, the gaming system reduces the displayed award amount and enables another round of picks.

In another embodiment, the gaming system initiates a group game having a plurality of different stages and initiates one of the stages of the group game that has not yet been provided. The gaming system displays a plurality of different selections. In this embodiment, each of the displayed selections is associated with a quantity of one or more points. For each of a plurality of gaming machines, the gaming system receives a pick of one of the displayed selections from a player of that gaming machine. For each picked selection, the gaming system adds the quantity of points associated with that picked selection to a total quantity of points for the current stage. The gaming system determines whether the total quantity of points for the current stage is at least equal to a target quantity of points. Put differently, the gaming system determines whether the players collectively accumulated at least the target quantity of points during the current stage.

If the total quantity of points for the current stage is not at least equal to the target quantity of points, the gaming system ends the group game. If, on the other hand, the total quantity of points for the current stage is at least equal to the target quantity of points, the gaming system provides an award amount associated with the current stage to one or more of the players. The gaming system determines whether any of the stages of the group game have not yet been provided (i.e., determines whether any of the stages of the group game remain unplayed). If all of the stages of the group game have been provided, the gaming system ends the group game. If, on the other hand, at least one of the stages of the group game has not yet been provided the gaming system initiates an unplayed stage of the group game.

It should thus be appreciated that the gaming system and method of the present disclosure provide a new group game to increase player enjoyment, entertainment, and excitement.

Additional features and advantages are described herein, and will be apparent from, the following Detailed Description and the Figures.

DETAILED DESCRIPTION

Group Game Having Multiple Stages

Various embodiments of the present disclosure provide a gaming system and method providing a multiple-stage group game having a same average expected total payback percentage regardless of the number of players participating in the group game. In various embodiments, the gaming system determines or sets one or more characteristics, features, or parameters of the group game based on the number of players participating in the group game such that the average expected total payback percentage of the group game is the same or substantially the same for each play of the group game regardless of the number of players participating in that play of the group game.

While the group game is employed as a bonus game in the embodiments described below, it should be appreciated that the group game may additionally or alternatively be employed as or in association with a primary wagering game. While any credit balances, any wagers, and any awards are displayed as amounts of monetary currency or credits in the embodiments described below, one or more of such credit balances, such wagers, and such awards may be for any suitable non-monetary credits or currency, promotional credits, and/or player tracking points or credits.

First Example Embodiment

Figure 1:
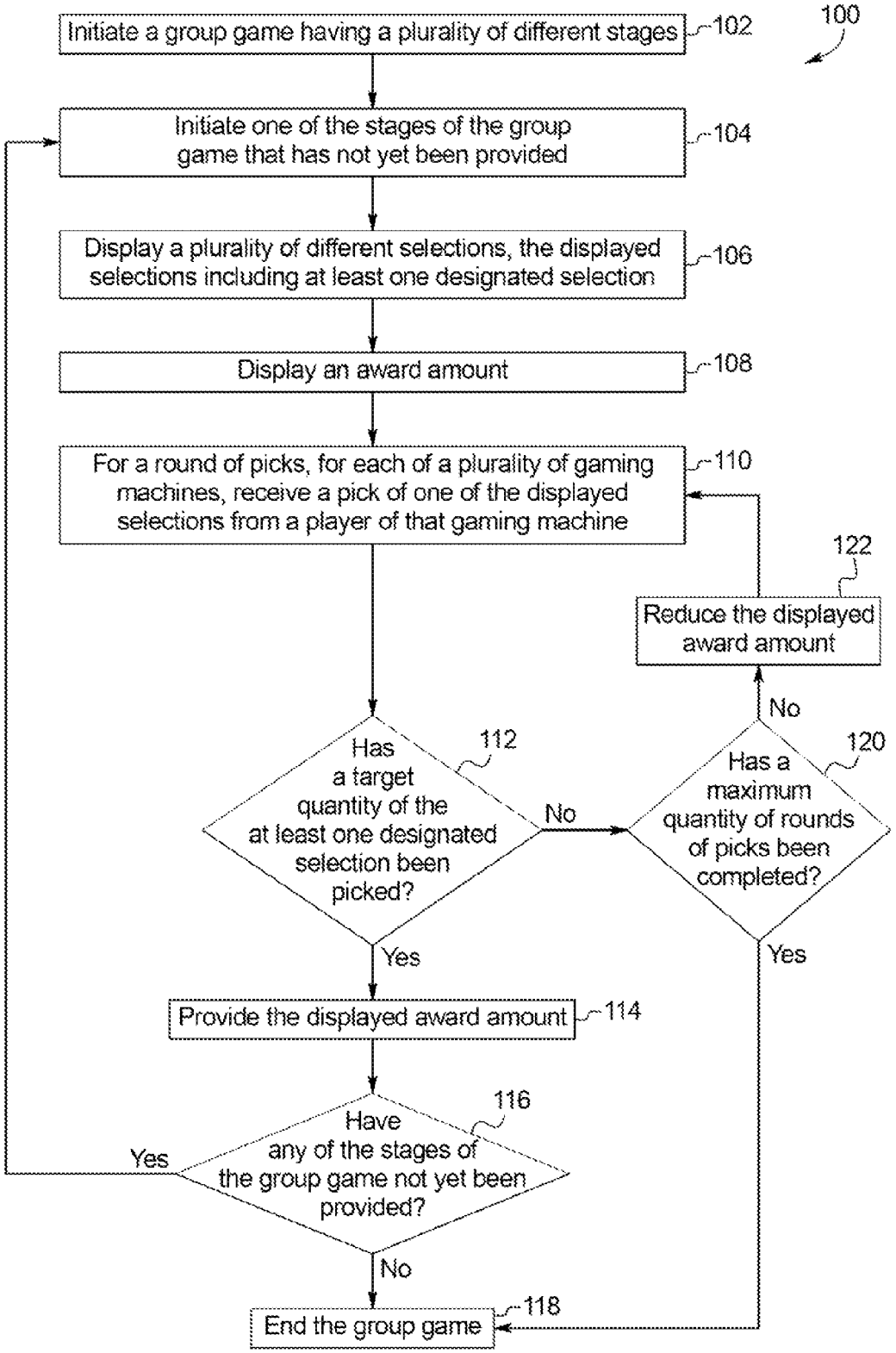
FIG. 1 is a flowchart illustrating an example method of operating one embodiment of the gaming system of the present disclosure.

FIG. 1 illustrates a flowchart of an example process or method 100 of operating one embodiment of the gaming system of the present disclosure. In various embodiments, the process 100 is represented by a set of instructions stored in one or more memories and executed by one or more processors. Although the process 100 is described with reference to the flowchart shown in FIG. 1, it should be appreciated that many other processes of performing the acts associated with this illustrated process 100 may be employed. For example, the order of certain of the illustrated blocks and/or diamonds may be changed, certain of the illustrated blocks and/or diamonds may be optional, and/or certain of the illustrated blocks and/or diamonds may not be employed.

In operation of this example embodiment, the gaming system initiates a group game having a plurality of different stages, as indicated by block 102. The gaming system initiates one of the stages of the group game that has not yet been provided, as indicated by block 104. The gaming system displays a plurality of different selections, as indicated by block 106. In this example embodiment, the plurality of displayed selections include at least one designated selection. The gaming system displays an award amount associated with the current stage of the group game, as indicated by block 108. For a round of picks, for each of a plurality of gaming machines, the gaming system receives a pick of one of the displayed selections from a player of that gaming machine, as indicated by block 110.

The gaming system determines whether a target quantity of the at least one designated selection has been picked during the current stage, as indicated by diamond 112. If the gaming system determines that the target quantity of the at least one designated selection has not yet been picked during the current stage, the process 100 proceeds to diamond 120, described below. If, on the other hand, the gaming system determines that the target quantity of the at least one designated selection has been picked during the current stage, the gaming system provides the displayed award amount to one or more of the players of the gaming machines, as indicated by block 114.

The gaming system determines whether any of the stages of the group game have not yet been provided (i.e., determines whether any of the stages of the group game remain unplayed). If the gaming system determines that all of the stages of the group game have been provided, the gaming system ends the group game, as indicated by block 118. If, on the other hand, the gaming system determines that at least one of the stages of the group game has not yet been provided (i.e., determines that at least one of the stages of the group game remains unplayed), the process 100 returns to block 104 and the gaming system initiates an unplayed stage of the group game.

Returning to the diamond 112, if the gaming system determines that the target quantity of the at least one designated selection has not yet been picked during the current stage, the gaming system determines whether a maximum quantity of rounds of picks has been completed during the current stage, as indicated by block 120. If the gaming system determines that the maximum quantity rounds of picks has been completed during the current stage, the gaming system ends the group game, as indicated by block 118. If, on the other hand, the gaming system determines that the maximum quantity of rounds of picks has not yet been completed during the current stage, the gaming system reduces the displayed award amount, as indicated by block 122, and process 100 returns to block 110.

FIGS. 2A, 2B, 2C, 2D, 2E, 2F, 2G, 2H, and 2I illustrate screenshots of a play of one example embodiment of the group game of the present disclosure according to the process 100. In this example embodiment, the group game is implemented as a bonus game. The group game includes two stages—a first stage and a second stage—and is played by players of four different gaming systems (such as electronic gaming machines (EGMs)). More specifically, in this example embodiment, the players of the group game include: (a) Joe, who plays an EGM having a display 1116*a*; (b) Dan, who plays an EGM having a display 1116*b*; (c) Alyssa, who plays an EGM having a display 1116*c*; and (d) Nick, who plays an EGM having a display 1116*d*.

Generally, in this example embodiment, the gaming system provides the first stage upon initiation of the group game (such as upon an occurrence of a bonus triggering event in association with a primary wagering game). During the first stage, the gaming system provides one or more rounds of picks in which the gaming system enables each player to pick one of a first plurality of selections until either: (a) one of the players picks a designated selection during the first stage, or (b) a maximum quantity of rounds of picks has been completed during the first stage without a player having picked the designated selection. In this example embodiment, the maximum quantity of rounds of picks is three. If one of the players picks the designated selection, the first stage is won and the gaming system: (a) provides each of the players an award, (b) ends the first stage, and (c) initiates the second stage. If the maximum quantity of three rounds of picks is completed without a player having picked the designated selection, the first stage is lost and the gaming system ends the group game.

It should be appreciated that since the first stage of the group game in this example embodiment is won when one of the players picks the designated selection, the likelihood of winning the first stage increases as the number of players participating in the group game increases. In other words, for: (a) for a particular number of selections, (b) a particular number of designated selections, (c) a particular target quantity of designated selections, and (d) a particular maximum quantity of rounds of picks, the first stage is more likely to be won if more players participate in the group game because the total number of picks that the players may collectively use in the first stage (if necessary) increases as the number of players increases. For instance, in this example embodiment, the total number of picks that the players may collectively use in the first stage (if necessary) is twelve (four players multiplied by the maximum number of three rounds of picks multiplied by one pick per player per round). If only two players were participating in the group game, however, the total number of picks that those players may collectively use in the first stage (if necessary) would be six, making it less likely that one of the players would pick the designated selection. Conversely, if six players were participating in the group game, the total number of picks that those players may collectively use in the first stage (if necessary) would be eighteen, making it more likely that one of the players would pick the designated selection.

Generally, in this example embodiment, in the second stage the gaming system provides one or more rounds of picks in which the gaming system enables each player to pick one of a second plurality of selections until either: (a) one of the players picks a designated selection during the second stage, or (b) the maximum quantity of rounds of picks (which may be the same as or different than the maximum quantity of rounds of picks associated with the first stage) has been completed during the second stage without a player having picked the designated selection. If one of the players picks the designated selection, the second stage is won and the gaming system: (a) provides each of the players an award, and (b) ends the group game. If none of the players picks the designated selection, the second stage is lost and the gaming system ends the group game.

It should be appreciated that since the second stage of the group game in this example embodiment is won when one of the players picks the designated selection, the likelihood of winning the second stage increases as the number of players participating in the group game increases. In other words, for: (a) for a particular number of selections, (b) a particular number of designated selections, (c) a particular target quantity of designated selections, and (d) a particular maximum quantity of rounds of picks, the second stage is more likely to be won if more players participate in the group game because the total number of picks that the players may collectively use in the second stage (if necessary) increases as the number of players increases.

Figure 2A:
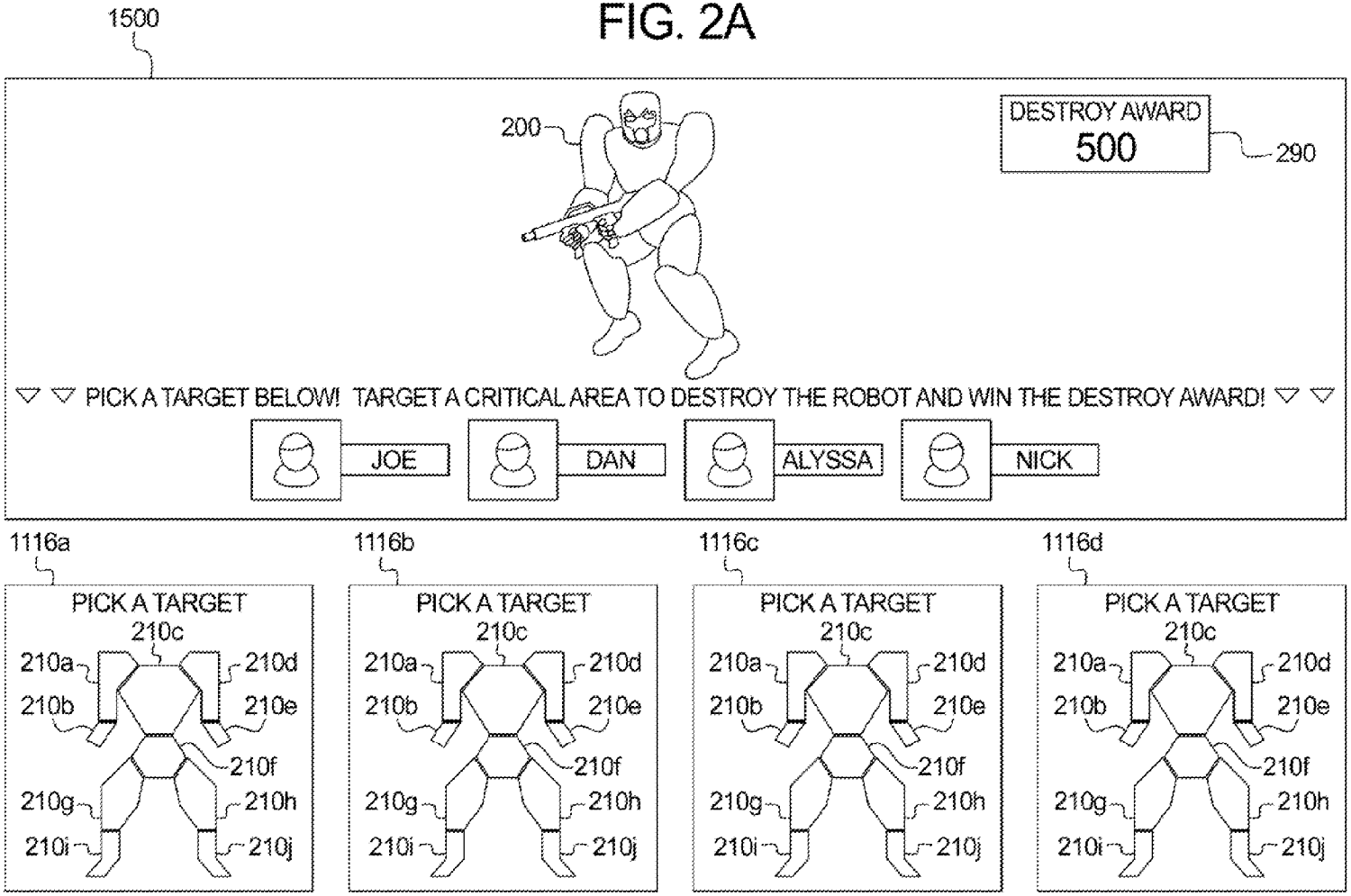
FIGS. 2A, 2B, 2C, 2D, 2E, 2F, 2G, 2H, and 2I illustrate screenshots of a play of one example embodiment of the group game of the present disclosure.

Turning to FIG. 2A, upon triggering the group game, the gaming system initiates the first stage of the group game. For the first stage of the group game, the gaming system displays on a shared display 1500: (a) a robot 200, and (b) an award meter 290 that displays an award of 500 credits associated with the first stage of the group game. Additionally, the gaming system displays a plurality of selections 210*a*, 210*b*, 210*c*, 210*d*, 210*e*, 210*f*, 210*g*, 210*h*, 210*i*, and 210*j* on each of the displays 1116*a*. 1116*b*, 1116*c*, and 1116*d* of the players' EGMs. In this example embodiment, the gaming system randomly determines that the selection 210*g* is the designated selection.

In this example embodiment, each of the selections is associated with an area or part of the robot 200. More specifically: (a) the selection 210*a* is associated with an upper left arm of the robot 200, (b) the selection 210*b* is associated with a lower left arm of the robot 200, (c) the selection 210*c* is associated with an upper torso of the robot 200, (d) the selection 210*d* is associated with an upper right arm of the robot 200, (e) the selection 210*e* is associated with a lower right arm of the robot 200, (f) the selection 210*f* is associated with a lower torso of the robot 200, (g) the selection 210*g* is associated with an upper left leg of the robot 200, (h) the selection 210*h* is associated with an upper right leg of the robot 200, (i) the selection 210*i* is associated with a lower left leg of the robot 200, and (j) the selection 210*j* is associated with a lower right leg of the robot 200.

The gaming system initiates a first round of picks in which the gaming system enables each of the players to pick one of the selections. In this example embodiment, during a given round of picks, the gaming system enables the players to simultaneously pick selections, though it should be appreciated that in other embodiments the gaming system enables the players to sequentially pick selections according to a certain order (such as a predetermined order or a randomly determined order).

Figure 2B:
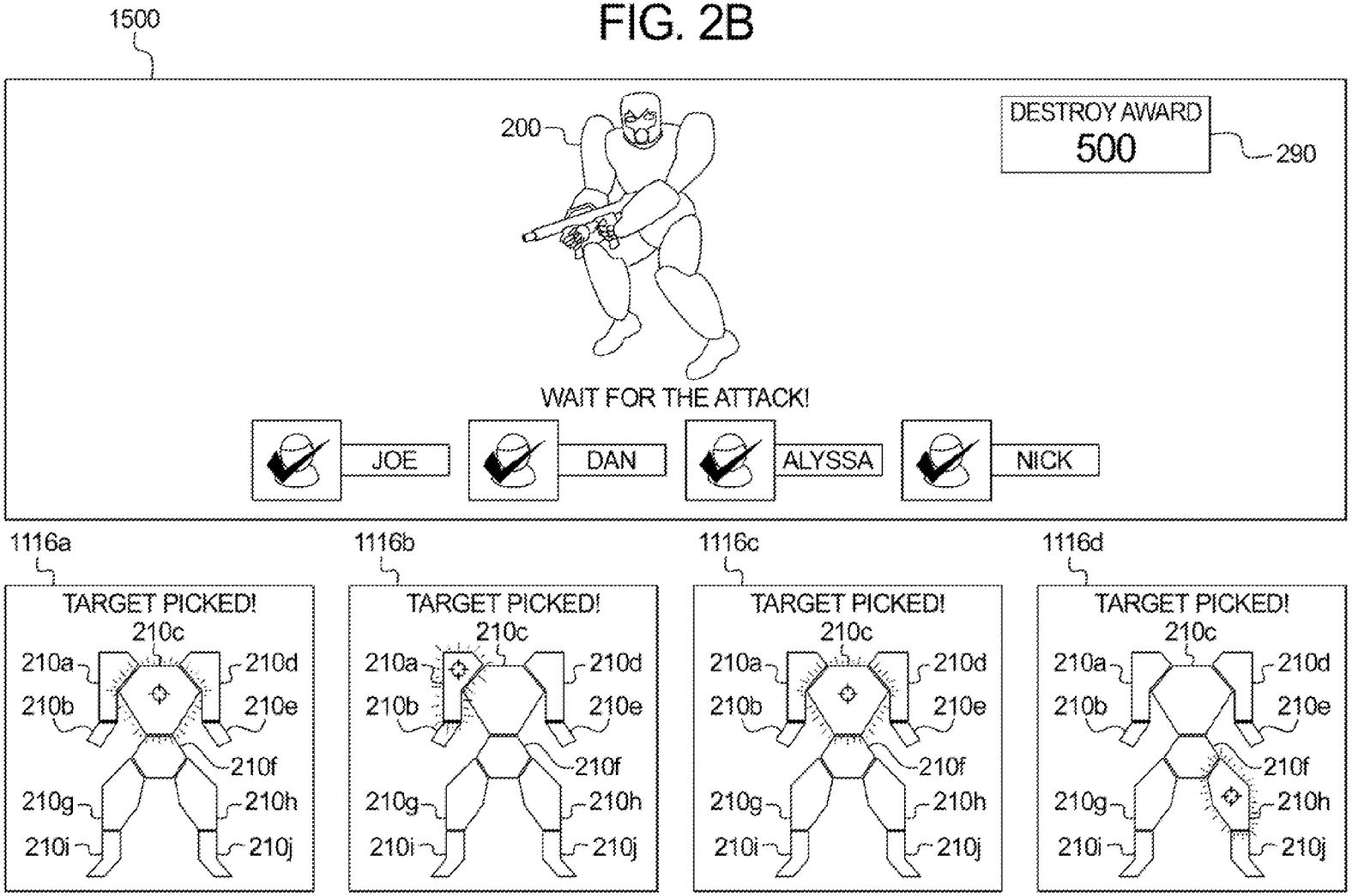

As illustrated in FIG. 2B, for the first round of picks during the first stage, the gaming system receives: (a) a pick of the selection 210*c* from Joe, (b) a pick of the selection 210*a* from Dan, (c) a pick of the selection 210*c* from Alyssa, and (d) a pick of the selection 210*h* from Nick. In this example embodiment, for each of the players, the gaming system does not display the selections picked by the other players on the display of that player's EGM. For instance, in this example embodiment, the gaming system does not display Dan's pick of the selection 210*a*, Alyssa's pick of the selection 210*c*, or Nick's pick of the selection 210*h* on the display 1116*a* of Joe's EGM. It should be appreciated that, in other embodiments, for each of the players, the gaming system displays the selections picked by the other players on the display of that player's EGM.

The gaming system determines whether the designated selection, which is the selection 210*g* in this example embodiment, has been picked during the first stage. Here, the gaming system has not yet received a pick of the selection 210*g* from any of the players and, therefore, the gaming system determines that the designated selection has not yet been picked during the first stage. Accordingly, the gaming system determines whether the maximum quantity of three rounds of picks has been completed during the first stage. At this point, only one round of picks has been completed during the first stage and, therefore, the gaming system determines that the maximum quantity of three rounds of picks has not yet been completed during the first stage.

Figure 2C:
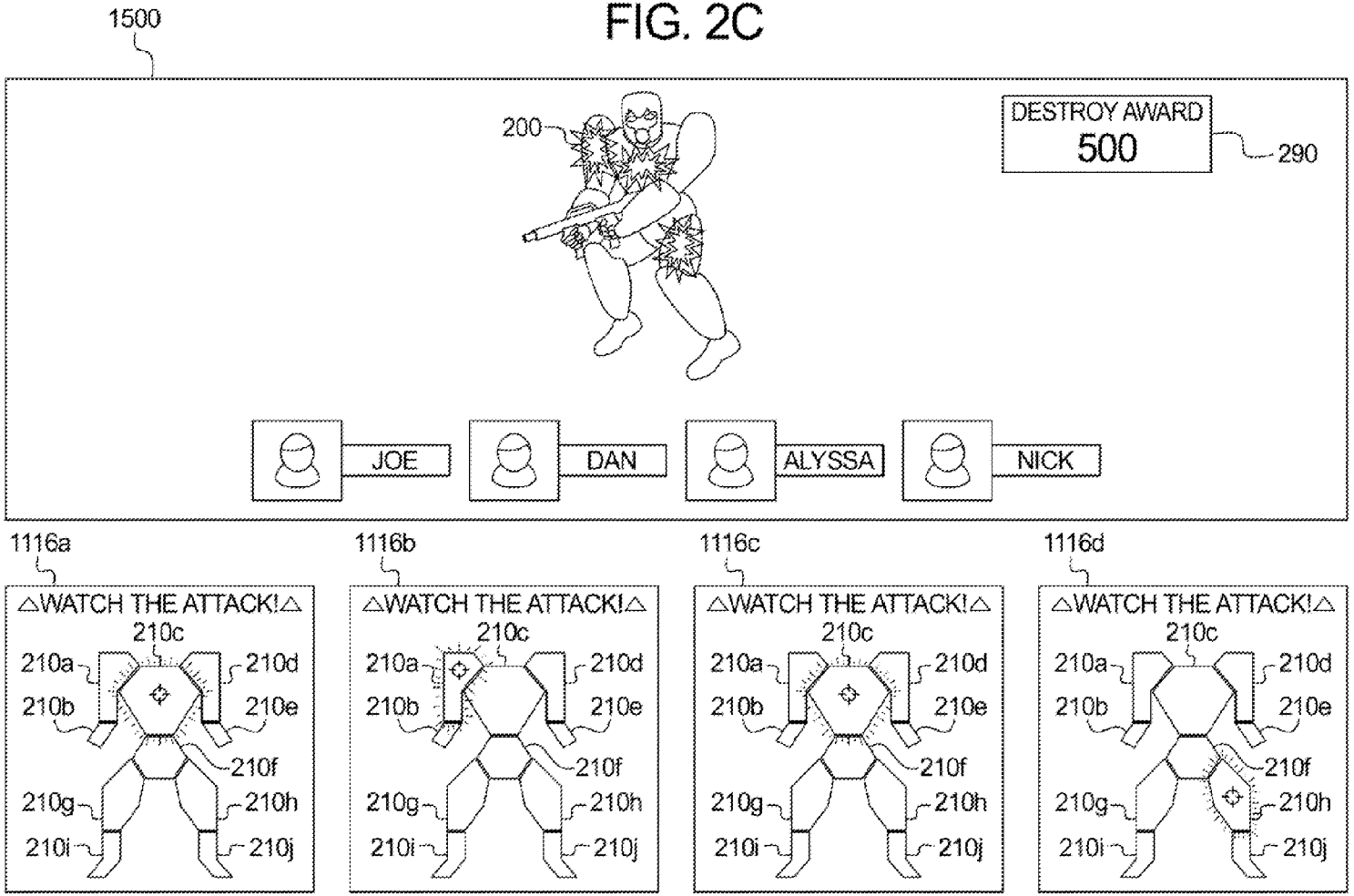

As shown in FIG. 2C, the gaming system displays an attack on each of the areas or parts of the robot 200 associated with the picked selections 210*a*, 210*c*, and 210*h*. More specifically, the gaming system displays an attack on: (a) the upper left arm of the robot 200 associated with the picked selection 210*a*, (b) the upper torso of the robot 200 associated with the picked selection 210*c*, and (c) the upper right leg of the robot 200 associated with the picked selection 210*h*.

Figure 2D:
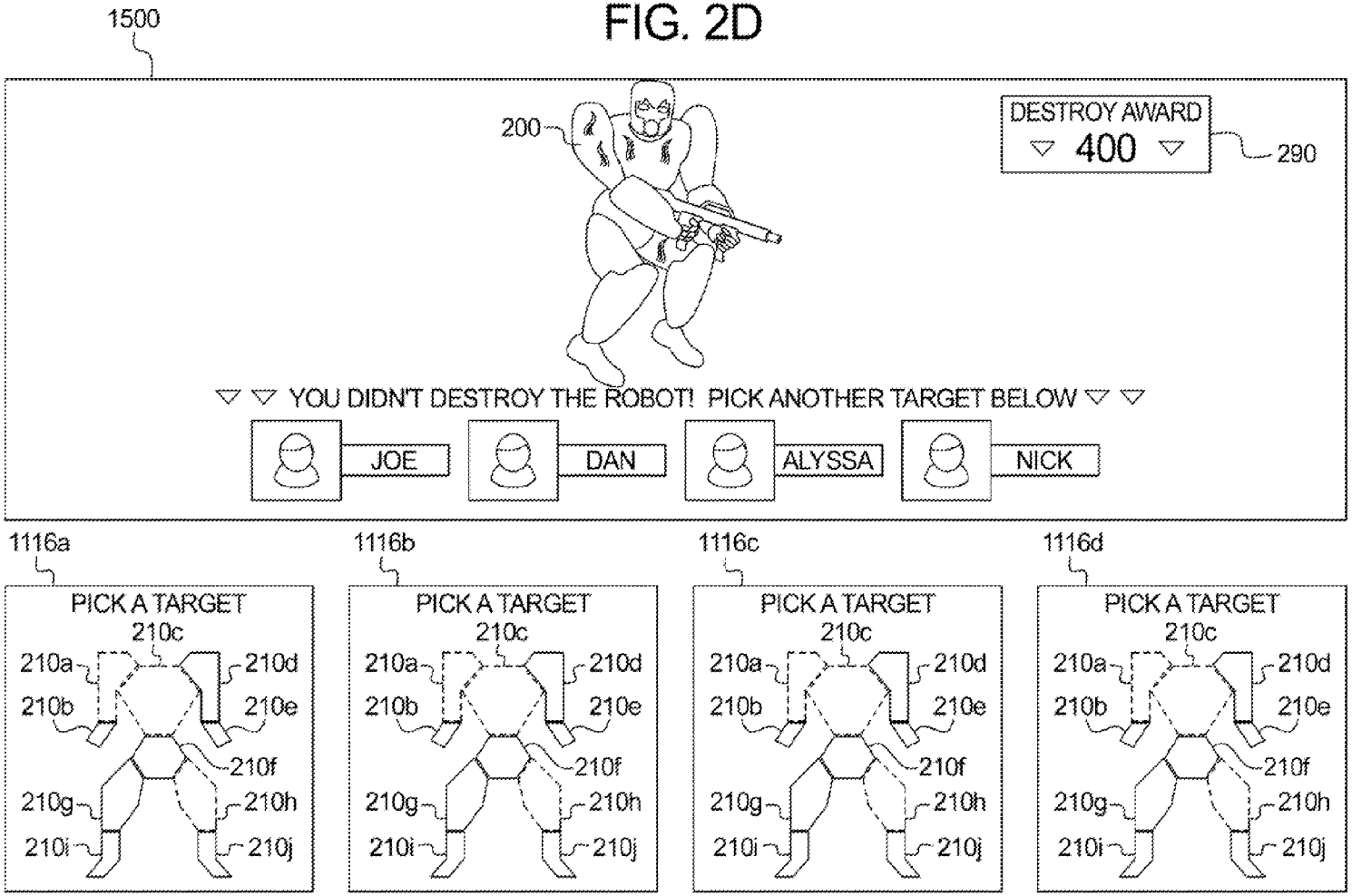

As shown in FIG. 2D, because the gaming system determined that the designated selection has not yet been picked during the first stage and that the maximum quantity of three rounds of picks has not yet been completed during the first stage, the gaming system reduces the displayed award from 500 credits to 400 credits, as shown in the award display 290, and initiates a second round of picks in which the gaming system enables each of the players to pick another one of the selections. Put differently, because each of the players failed to pick the designated selection with his or her pick in the first round of picks, the gaming system reduces the displayed award before initiating the second round of picks and enabling the players to pick again. In this example embodiment, the gaming system does not enable the players to pick the already-picked selections 210*a*, 210*c*, and 210*h* and, therefore, does not display those selections on the displays of the players' EGMs during the second round of picks.

Figure 2E:
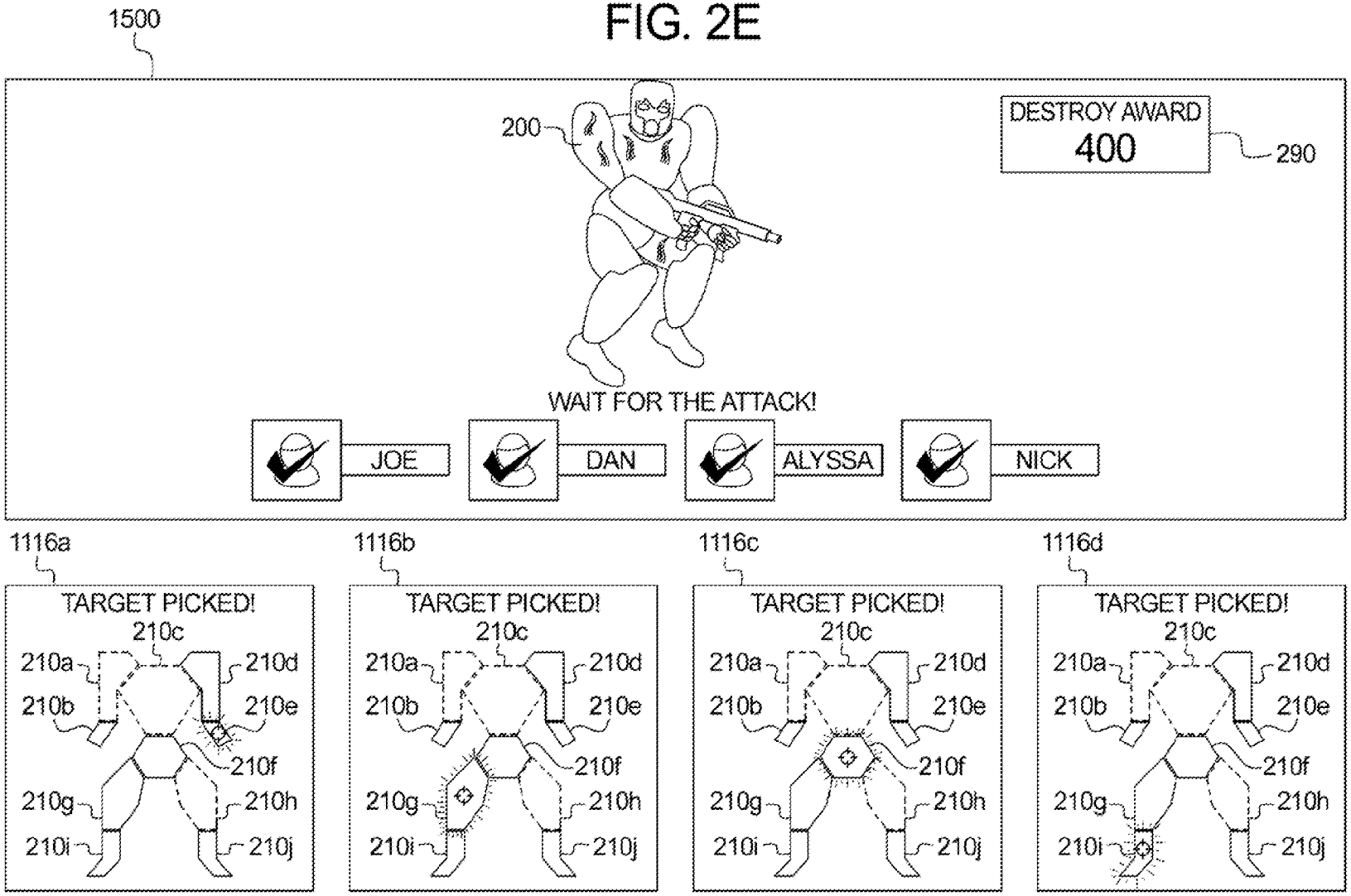
Figure 2F:
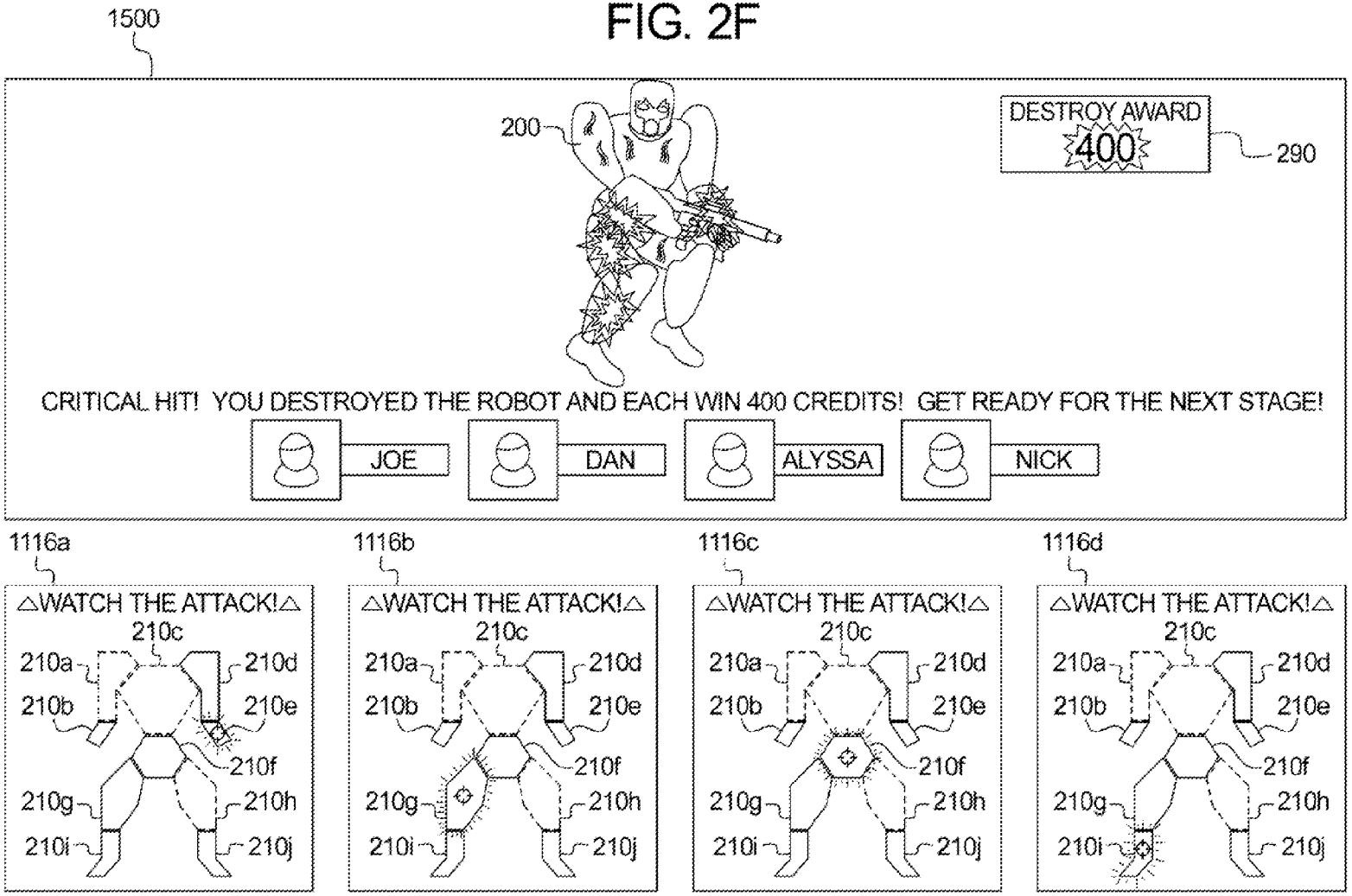

As shown in FIG. 2E, for the second round of picks during the first stage, the gaming system receives: (a) a pick of the selection 210*e* from Joe, (b) a pick of the selection 210*g* from Dan, (c) a pick of selection 210*f* from Alyssa, and (d) a pick of the selection 210*i* from Nick. The gaming system determines whether the designated selection, which is the selection 210*g* in this example embodiment, has been picked. Here, the gaming system received a pick of the selection 210*g* from Dan and, therefore, determines that the designated selection has been picked during the first stage. Accordingly, as shown in FIG. 2F, the gaming system: (a) displays an attack on the robot 200 and, more specifically, an attack on: (i) the lower right arm of the robot 200 associated with the picked selection 210*e*, (ii) the lower torso of the robot 200 associated with the picked selection 210*f*, (iii) the upper left leg of the robot 200 associated with the picked selection 210*g*, and (iv) the lower left leg of the robot 200 associated with the picked selection 210*i*; (b) provides the displayed 400 credit award to each of the players; (c) ends the first stage of the group game; and (d) initiates the second stage of the group game.

Figure 2G:
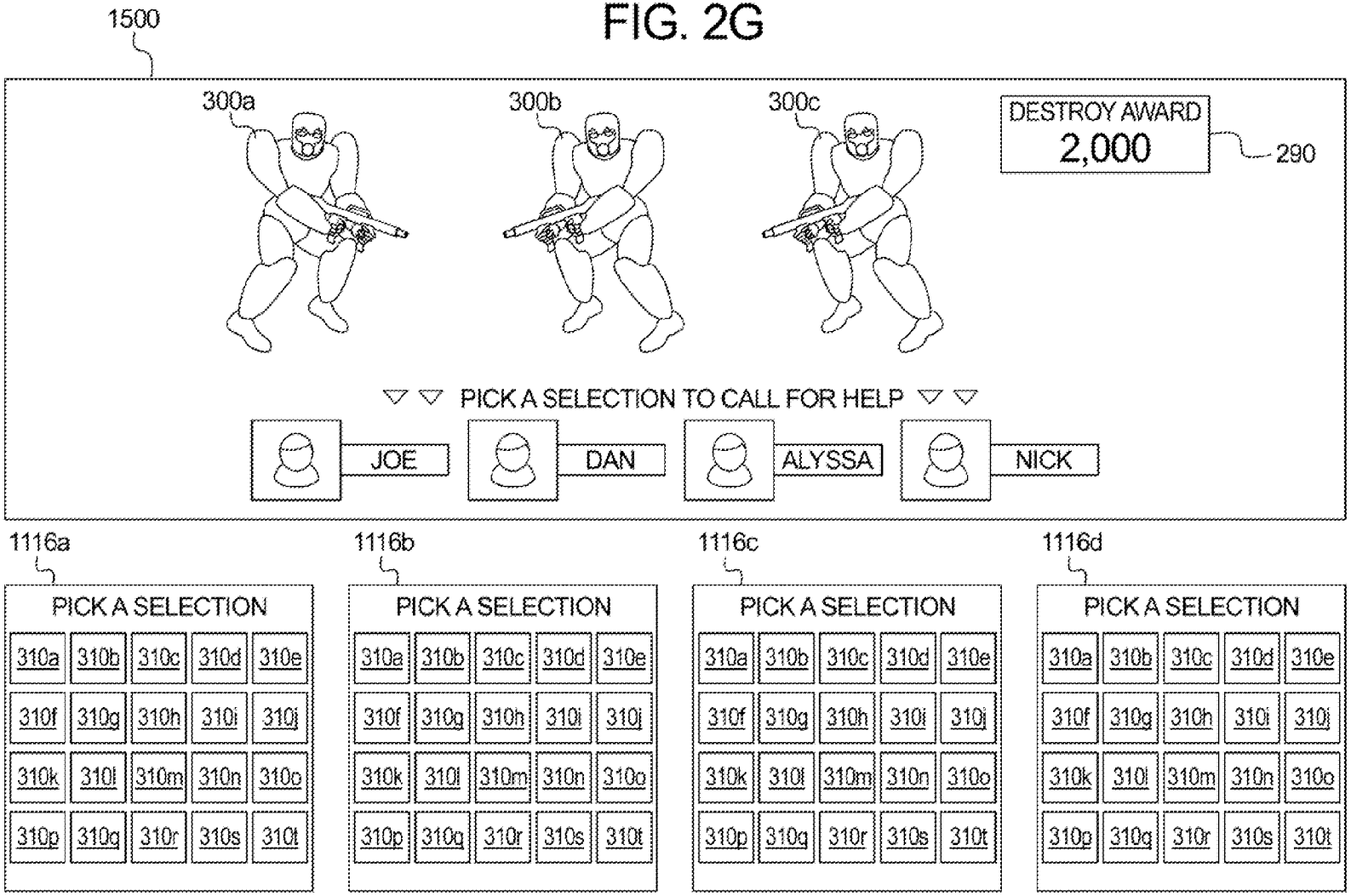

As illustrated in FIG. 2G, for the second stage of the group game, the gaming system displays on the shared display 1500: (a) three robots 300*a*, 300*b*, and 300*c*; and (b) an award of 2,000 credits associated with the second stage of the group game in the award meter 290. Additionally, the gaming system displays a plurality of selections 310*a*, 310*b*, 310*c*, 310*d*, 310*e*, 310*f*, 310*g*, 310*h*, 310*i*, 310*j*, 310*k*, 310*l*, 310*m*, 310*n*, 310*o*, 310*p*, 310*q*, 310*r*, 310*s*, and 310*t* on each of the displays 1116*a*, 1116*b*, 1116*c*, and 1116*d* of the players' EGMs. In this example embodiment, the gaming system randomly determines that the selection 310*f* is the designated selection. The gaming system initiates a first round of picks in which the gaming system enables each of the players of the EGMs to pick one of the selections.

Figure 2H:
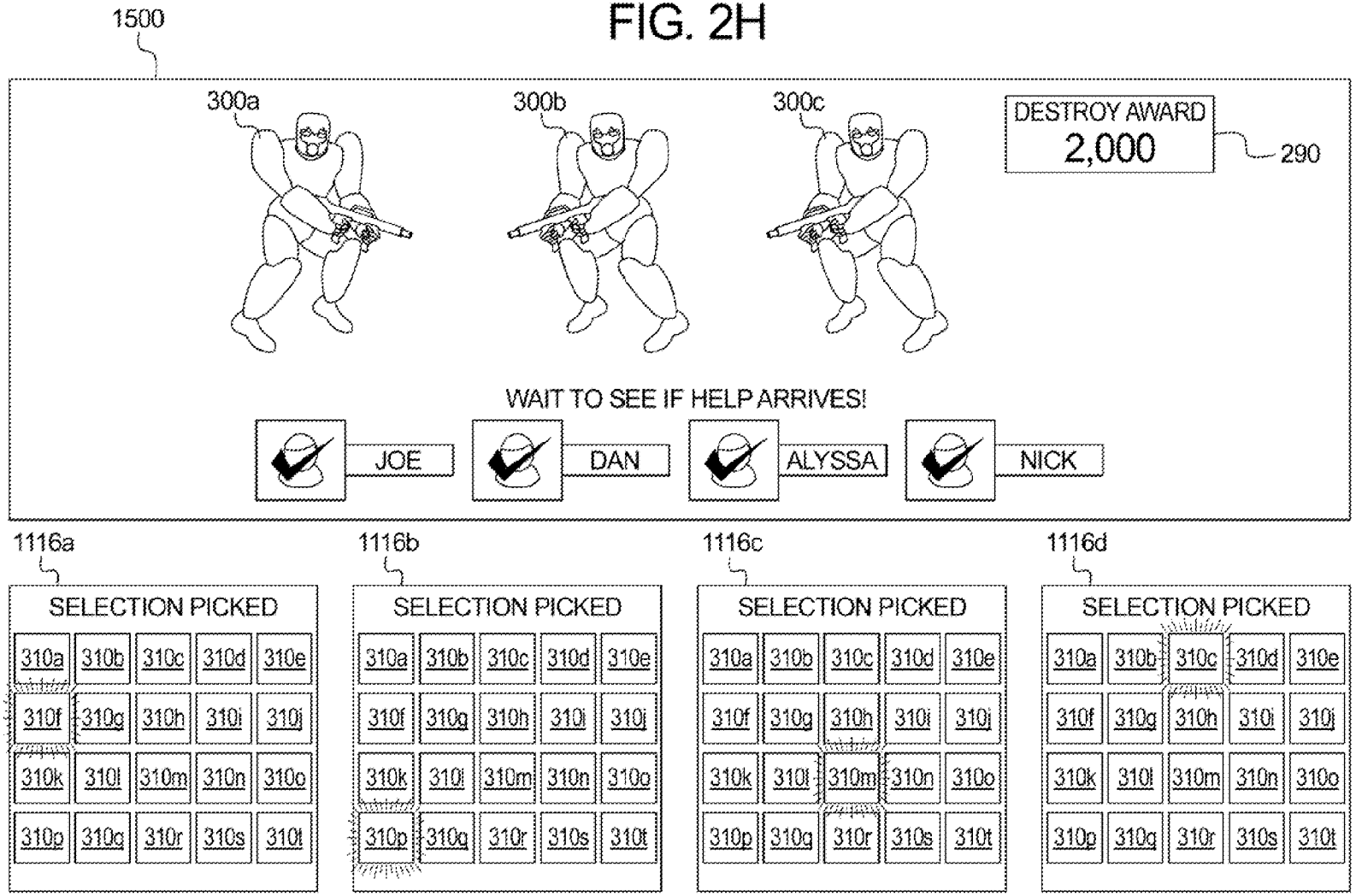
Figure 2I:
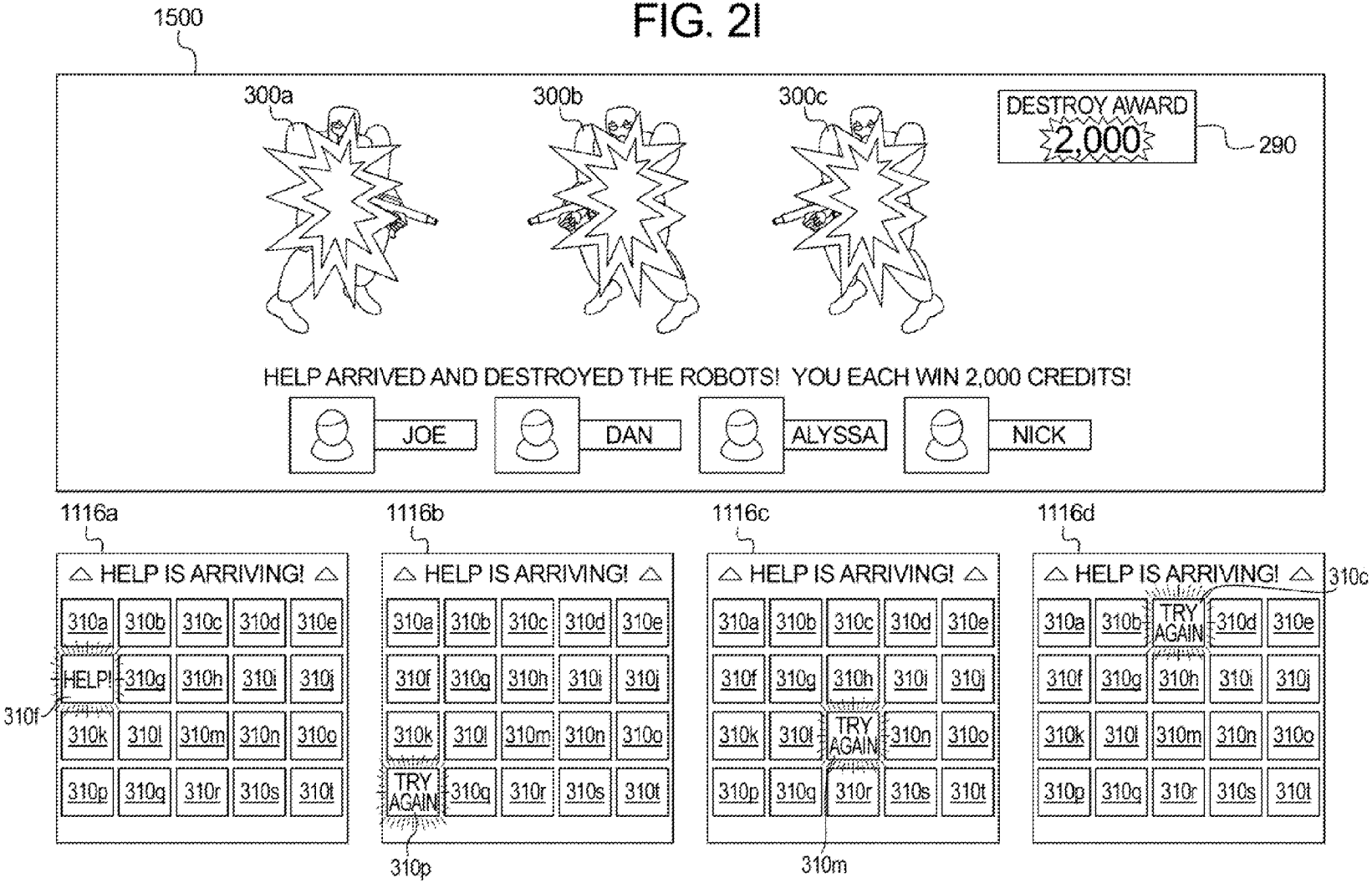

As illustrated in FIG. 2H, for the first round of picks during the second stage, the gaming system receives: (a) a pick of the selection 310*f* from Joe, (b) a pick of the selection 310*p* from Dan, (c) a pick of the selection 310*m* from Alyssa, and (d) a pick of the selection 310*c* from Nick. The gaming system determines whether the designated selection, which is the selection 310*f* in this example embodiment, has been picked during the second stage. Here, the gaming system received a pick of the selection 310*f* from Joe and, therefore, determines that the designated selection has been picked during the second stage. Accordingly, as shown in FIG. 2I, the gaming system: (a) displays an attack on the robots 300*a*, 300*b*, and 300*c*; (b) provides the displayed 2,000 credit award to each of the players; and (c) ends the group game.

In certain embodiments, the gaming system associates one or more of the selections (designated or non-designated selection(s)) with additional awards. In one such embodiment, when the gaming system receives a pick of one such selection from a player, the gaming system provides the player the additional award associated with the picked selection. In another such embodiment, when the gaming system receives a pick of one such selection from a player, the gaming system provides each of the players the additional award associated with the picked selection. In another such embodiment, when the gaming system receives a pick of one such selection from a player, the gaming system provides a portion of the additional award (such as an equal portion of the additional award) associated with the picked selection to each of the players.

In various embodiments, when a stage is won, the gaming system provides the displayed award associated with the stage to each of the players. In other embodiments, when a stage is won, the gaming system provides the displayed award associated with the stage to the player(s) who picked the selection(s) that resulted in the stage being won. In further embodiments, when a stage is won, the gaming system provides a portion of the displayed award (such as an equal portion of the displayed award) to each of the players.

In certain embodiments, the initially-displayed award amounts associated with the stages increase as the players progress through different stages. For instance, the initially-displayed award amount associated with a first stage is 500 credits; the initially-displayed award amount associated with a second stage is 1,000 credits; and the initially-displayed award amount associated with a third and final stage is 2,000 credits.

Generally, the average expected total payback percentage of the group game, which is the average percentage of money wagered on the primary wagering game that is paid back to the players during the group game, is determined by: (a) the award(s) available to be won in the group game, and (b) the probability that such award(s) will be won in the group game. Thus, modifying: (a) the award(s) available to be won in the group game, or (b) the probability that such award(s) will be won in the group game will, in certain instances, change the average expected total payback percentage of the group game. For example, lowering the probability that an award will be won in the group game without modifying the amount of that award will lower the average expected total payback percentage of the group game, and vice-versa. Further, lowering an amount of one of the awards available to be won in the group game without modifying the probability that that award will be won will lower the average expected total payback percentage of the group game, and vice-versa.

In other instances, modifying both: (a) the award(s) available to be won in the group game, and (b) the probability that such award(s) will be won in the group game in certain manners will, in certain instances, not change or substantially change the average expected total payback percentage of the group game, but will change one or more features of the group game. For example, lowering the probability that an award will be won in the group game while also increasing the amount of that award in a corresponding manner will not change or substantially change the average expected total payback percentage of the group game, but makes that award more difficult to win and more lucrative when won. Conversely, increasing the probability that an award will be won in the group game while also decreasing the amount of that award in a corresponding manner will not change or substantially change the average expected total payback percentage of the group game, but will make that award easier to win and less lucrative when won.

In certain embodiments, the average expected total payback percentage of the group game does not change or substantially change (e.g., falls within a designated range of average expected total payback percentages) based on the number of players participating in the group game. In other words, in these embodiments, the gaming system ensures that the number of players participating in the group game does not impart an advantage or a substantial advantage in the group game. It should also be appreciated that, in certain such embodiments, for a play of the group game, the average expected payout for each player participating in that play of the group game is the same or substantially the same.

In various embodiments, the gaming system determines or sets one or more characteristics, features, or parameters of the group game based on the number of players participating in the group game such that the average expected total payback percentage of the group game is the same or substantially the same for each play of the group game regardless of the number of players participating in that play of the group game. Thus, in these embodiments, upon initiation of a play of the group game, the gaming system determines the number of players participating in the group game and then sets the one or more characteristics, features, or parameters of the group game based on the determined number of players participating in the group game such that the average expected total payback percentage of the group game is a designated average expected payback percentage.

In various embodiments, the gaming system determines or sets the initial award associated with a stage of the group game based on the number of players participating in the group game such that the average expected total payback percentage of the group game is the same or substantially the same regardless of the number of players participating in the group game. Here, for a given stage of the group game, as the number of players participating in the group game increases, the total number of picks that those players may collectively use during the stage (if necessary) increases, which increases the probability that those players will pick the target quantity of designated selections and win the stage (and its associated award). Accordingly, in these embodiments, as the number of players participating in the group game increases, the gaming system determines lower initial awards associated with the stage to offset the higher probability that the players participating in the group game will pick the target quantity of designated selections to win the stage (and its associated award), thereby maintaining a desired average expected total payback percentage for the group game.

Conversely, for a given stage of the group game, as the number of players participating in the group game decreases, the total number of picks that those players may collectively use during the stage (if necessary) decreases, which decreases the probability that those players will pick the target quantity of designated selections and win the stage (and its associated award). Accordingly, in these embodiments, as the number of players participating in the group game decreases, the gaming system determines higher initial awards associated with the stage to compensate for the lower probability that the players participating in the group game will pick the target quantity of designated selections to win the stage (and its associated award), thereby maintaining a desired average expected total payback percentage for the group game.

Thus, in these embodiments, for a given stage: (a) when a relatively small number of players are participating in the group game, those players have a relatively low probability of winning the stage, which is associated with a relatively large award; and (b) when a relatively large number of players are participating in the group game, those players have a relatively high probability of winning the stage, which is associated with a relatively small award. For example: (a) if two players are participating in the group game, those players have a 10% probability of winning the first stage, and the gaming system determines an initial award of 1,000 credits associated with the first stage; (b) if four players are participating in the group game, those players have a 20% probability of winning the first stage, and the gaming system determines an initial award of 500 credits associated with the first stage; and (c) if eight players are participating in the group game, those players have a 40% probability of winning the first stage, and the gaming system determines an initial award of 250 credits associated with the first stage.

In certain embodiments, the gaming system determines or sets the quantity of displayed selections that are designated selections based on the number of players participating in the group game such that the average expected total payback percentage of the group game is the same or substantially the same regardless of the number of players participating in the group game. Here, for a given stage of the group game and for a given quantity of designated selections, as the number of players participating in the group game increases, the total number of picks that those players may collectively use during the stage (if necessary) increases, which increases the probability that those players will pick the target quantity of designated selections and win the stage (and its associated award). Accordingly, in these embodiments, as the number of players participating in the group game increases, the gaming system determines and provides lower quantities of designated selections to maintain a desired probability that the players participating in the group game will pick the target quantity of designated selections to win the stage (and its associated award), thereby maintaining a desired average expected total payback percentage for the group game.

Conversely, for a given stage of the group game and for a given quantity of designated selections, as the number of players participating in the group game decreases, the total number of picks that those players may collectively use during the stage (if necessary) decreases, which decreases the probability that those players will pick the target quantity of designated selections and win the stage (and its associated award). Accordingly, in these embodiments, as the number of players participating in the group game decreases, the gaming system determines and provides higher quantities of designated selections to maintain the desired probability that the players participating in the group game will pick the target quantity of designated selections to win the stage (and its associated award), thereby maintaining a desired average expected total payback percentage for the group game.

Thus, in these embodiments, for a given stage, the players participating in the group game have the same or substantially the same probability (i.e., the desired probability) of winning the stage (and its associated award) regardless of the number of players participating in the group game. For example; (a) if two players are participating in the group game, the gaming system determines and provides a quantity of four designated selections and, therefore, those players have a 40% probability of winning the first stage; (b) if four players are participating in the group game, the gaming system determines and provides a quantity of two designated selections and, therefore, those players also have a 40% probability of winning the first stage; and (c) if eight players are participating in the group game, the gaming system determines and provides a quantity of one designated selection and, therefore, those players have a 40% probability of winning the first stage.

In various embodiments in which the gaming system associates one or more of the selections with additional awards, the gaming system determines or sets: (a) the quantity of selections associated with additional awards, and/or (b) the amount of such additional awards based on the number of players participating in the group game such that the average expected total payback percentage of the group game is the same or substantially the same regardless of the number of players participating in the group game. Here, for a given stage of the group game, as the number of players participating in the group game increases, the total number of picks that those players may collectively use during the stage (if necessary) increases, which increases: (a) the probability that those players will pick the target quantity of designated selections and win the stage (and its associated award), and (b) the probability that those players will pick the selections associated with additional awards. Accordingly, in these embodiments, as the number of players participating in the group game increases, the gaming system determines: (a) lower quantities of selections associated with additional awards, and/or (b) lower amounts of such additional awards to offset the higher probability that the players participating in the group game will pick the target quantity of designated selections to win the stage (and its associated award) and the higher probability that the players participating in the group game will pick one of the selections associated with additional awards, thereby maintaining a desired average expected total payback percentage for the group game.

Conversely, for a given stage of the group game, as the number of players participating in the group game decreases, the total number of picks that those players may collectively use during the stage (if necessary) decreases, which decreases: (a) the probability that those players will pick the target quantity of designated selections and win the stage (and its associated award), and (b) the probability that those players will pick the selections associated with additional awards. Accordingly, in these embodiments, as the number of players participating in the group game decreases, the gaming system determines: (a) higher quantities of selections associated with additional awards, and/or (b) higher amounts of such additional awards to offset the lower probability that the players participating in the group game will pick the target quantity of designated selections to win the stage (and its associated award) and the lower probability that the players participating in the group game will pick one of the selections associated with additional awards, thereby maintaining a desired average expected total payback percentage for the group game.

Thus, in these embodiments, for a given stage: (a) when a relatively small number of players are participating in the group game, those players: (i) have a relatively high probability of picking a selection associated with an additional award, and/or (ii) win a relatively large additional award after picking a selection associated with an additional award; and (b) when a relatively large number of players are participating in the group game, those players: (i) have a relatively low probability of picking a selection associated with an additional award, and/or (ii) win a relatively low additional award after picking a selection associated with an additional award. For example: (a) if two players are participating in the group game, the gaming system associates four selections with an additional award of 40 credits; (b) if four players are participating in the group game, the gaming system associates two selections with an additional award of 20 credits; and (c) if eight players are participating in the group game, the gaming system associates one selection with an additional award of 10 credits.

In certain embodiments, the gaming system determines or sets the amount by which the gaming system reduces the award after a round of picks when the players have not picked the target quantity of designated selections based on the number of players participating in the group game such that the average expected total payback percentage of the group game is the same or substantially the same regardless of the number of players participating in the group game. Here, for a given stage of the group game, as the number of players participating in the group game increases, the total number of picks that those players may collectively use during the stage (if necessary) increases, which increases the probability that those players will pick the target quantity of designated selections and win the stage (and its associated award). Accordingly, in these embodiments, as the number of players participating in the group game increases, the gaming system determines higher amounts by which the gaming system reduces the award associated with the stage after a round of picks when the players have not yet picked the target quantity of designated selections to offset the higher probability that the players participating in the group game will pick the target quantity of designated selections to win the stage (and its associated award), thereby maintaining a desired average expected total payback percentage for the group game.

Conversely, for a given stage of the group game, as the number of players participating in the group game decreases, the total number of picks that those players may collectively use during the stage (if necessary) decreases, which decreases the probability that those players will pick the target quantity of designated selections and win the stage (and its associated award). Accordingly, in these embodiments, as the number of players participating in the group game decreases, the gaming system determines lower amounts by which the gaming system reduces the award associated with the stage after a round of picks when the players have not yet picked the target quantity of designated selections compensate for the lower probability that the players participating in the group game will pick the target quantity of designated selection to win the stage (and its associated award), thereby maintaining a desired average expected total payback percentage for the group game.

Thus, in these embodiments, for a given stage: (a) when a relatively small number of players are participating in the group game, those players have a relatively low probability of winning the stage, but the gaming system decreases the award associated with the stage by a relatively small amount after a round of picks if the players have not yet won the stage; and (b) when a relatively large number of players are participating in the group game, those players have a relatively high probability of winning the stage, but the gaming system decreases the award associated with the stage by a relatively large amount after a round of picks if the players have not yet won the stage. For example, for a given stage: (a) if two players are participating in the group game, those players have a 10% probability of winning the stage, and the gaming system decreases the award associated with the first stage after a round of picks by 10% if the players have not yet won the stage; (b) if four players are participating in the group game, those players have a 20% probability of winning the stage, and the gaming system decreases the award associated with the first stage by 20% after a round of picks if the players have not yet won the stage; and (c) if eight players are participating in the group game, those players have a 40% probability of winning the first stage, and the gaming system decreases the award associated with the stage by 40% after a round of picks if the players have not yet won the stage.

In various embodiments, the gaming system determines or sets the maximum quantity of rounds of picks based on the number of players participating in the group game such that the average expected total payback percentage of the group game is the same or substantially the same regardless of the number of players participating in the group game. Here, for a given stage of the group game, as the number of players participating in the group game increases: (a) the total number of picks that those players may collectively use during the stage (if necessary) increases, and (b) the total number of picks that those players actually collectively use per round of picks increases, which increases the probability that those players will pick the target quantity of designated selections and win the stage (and its associated award). Accordingly, in these embodiments, as the number of players participating in the group game increases, the gaming system determines lower maximum quantities of rounds of picks to offset the higher number of picks per round, thereby maintaining a desired average expected total payback percentage for the group game.

Conversely, for a given stage of the group game, as the number of players participating in the group game decreases: (a) the total number of picks that those players may collectively use during the stage (if necessary) decreases, and (b) the total number of picks that those players actually collectively use per round of picks decreases, which decreases the probability that those players will pick the target quantity of designated selections and win the stage (and its associated award). Accordingly, in these embodiments, as the number of players participating in the group game decreases, the gaming system determines higher maximum quantities of rounds of picks to compensate for the lower number of picks per round, thereby maintaining a desired average expected total payback percentage for the group game.

Thus, in these embodiments, for a given stage, the players participating in the group game have the same or substantially the same probability of winning the stage (and its associated award) regardless of the number of players participating in the group game because the number of picks that each set of players may collectively use during play of the group game is the same or substantially the same. For example: (a) if two players are participating in the group game, the gaming system determines a maximum quantity of four rounds of picks for the first stage; (b) if four players are participating in the group game, the gaming system determines a maximum quantity of two rounds of picks for the first stage; and (c) if eight players are participating in the group game, the gaming system determines a maximum quantity of one round of picks for the first stage.

In certain embodiments, the gaming system determines or sets the target quantity of designated selections based on the number of players participating in the group game such that the average expected total payback percentage of the group game is the same or substantially the same regardless of the number of players participating in the group game. Here, for a given stage of the group game and for a given target quantity of designated selections, as the number of players participating in the group game increases, the total number of picks that those players may collectively use during the stage (if necessary) increases, which increases the probability that those players will pick the target quantity of designated selections and win the stage (and its associated award). Accordingly, in these embodiments, as the number of players participating in the group game increases, the gaming system determines higher designated quantities of designated selections to maintain the desired probability that the players participating in the group game will pick the target quantity of designated selections to win the stage (and its associated award), thereby maintaining a desired average expected total payback percentage for the group game.

Conversely, for a given stage of the group game and for a given target quantity of designated selections, as the number of players participating in the group game decreases, the total number of picks that those players may collectively use during the stage (if necessary) decreases, which decreases the probability that those players will pick the target quantity of designated selections and win the stage (and its associated award). Accordingly, in these embodiments, as the number of players participating in the group game decreases, the gaming system determines lower designated quantities of designated selections to maintain the desired probability that the players participating in the group game will pick the target quantity of designated selections to win the stage (and its associated award), thereby maintaining a desired average expected total payback percentage for the group game.

Thus, in these embodiments, for a given stage, the players participating in the group game have the same or substantially the same probability (i.e., the desired probability) of winning the stage (and its associated award) regardless of the number of players participating in the group game. For example: (a) if two players are participating in the group game, the gaming system determines a target quantity of one designated selection and, therefore, those players have a 40% probability of winning the first stage; (b) if four players are participating in the group game, the gaming system determines a target quantity of two designated selections and, therefore, those players also have a 40% probability of winning the first stage; and (c) if eight players are participating in the group game, the gaming system determines a target quantity of four designated selections and, therefore, those players have a 40% probability of winning the first stage.

It should be appreciated that while the above-described example embodiments vary the award amounts, the probabilities, and/or any other suitable feature(s) employed for a play of the group game such that the average expected total payback percentage of the group game does not change or substantially change based on the number of players participating in the group game, in other embodiments the gaming system modifies the weightings of a weighted table used to determine any such feature(s).

For instance, in one example embodiment, the gaming system randomly selects an initial award from the following set of initial awards for a given stage of the group game: (a) 100 credits, (b) 500 credits, and (c) 1.000 credits. In embodiments in which a relatively small number of players are participating in the group game, the gaming system weighs the 1,000 credit award the heaviest, followed by the 500 credit award and the 100 credit award. Conversely, in embodiment in which a relatively large number of players are participating in the group game, the gaming system weighs the 100 credit award the heaviest, followed by the 500 credit award and the 1,000 credit award.

It should be appreciated that:

(a) how the group game is triggered;
(b) the number of players participating in the group game;
(c) the quantity of stages;
(d) the quantity of selections;
(e) the theme of the group game;
(f) the initial award associated with each stage;
(g) the amount by which the gaming system reduces the displayed award after a round of picks when the players have yet to pick the target quantity of designated selections;
(h) the target quantity of designated selections;
(i) which particular selections are designated selections;
(j) whether the gaming system enables sequential or simultaneous picking of selections;
(k) whether the gaming system enables players to see other players' picks;
(l) the manner or manners in which the gaming system ensures that the average expected total payback percentage of the group game is the same or substantially the same regardless of the number of players participating in the group game;
(m) the number of rounds of picks in each stage;
(n) the number of picks per player per round of picks; and/or
(o) any other variables or determinations described herein may be: (1) predetermined; (2) randomly determined; (3) randomly determined based on one or more weighted percentages (such as according to a weighted table); (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an electronic gaming machine (EGM) configured to operate the slot game (described below); (9) determined independent of a random determination at the EGM; (10) determined based on at least one play of at least one game; (11) determined independent of at least one play of at least one game; (12) determined based on a player's selection; (13) determined independent of a player's selection; (14) determined based on one or more side wagers placed; (15) determined independent of one or more side wagers placed; (16) determined based on the player's primary game wager or wager level; (17) determined independent of the player's primary game wager or wager level; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (i.e., a player tracking status); (23) determined independent of a status of the player (i.e., a player tracking status); (24) determined based on one or more other determinations disclosed herein; (25) determined independent of any other determination disclosed herein; and/or (26) determined in any other suitable manner or based on or independent of any other suitable factor(s).

Second Example Embodiment

Figure 3:
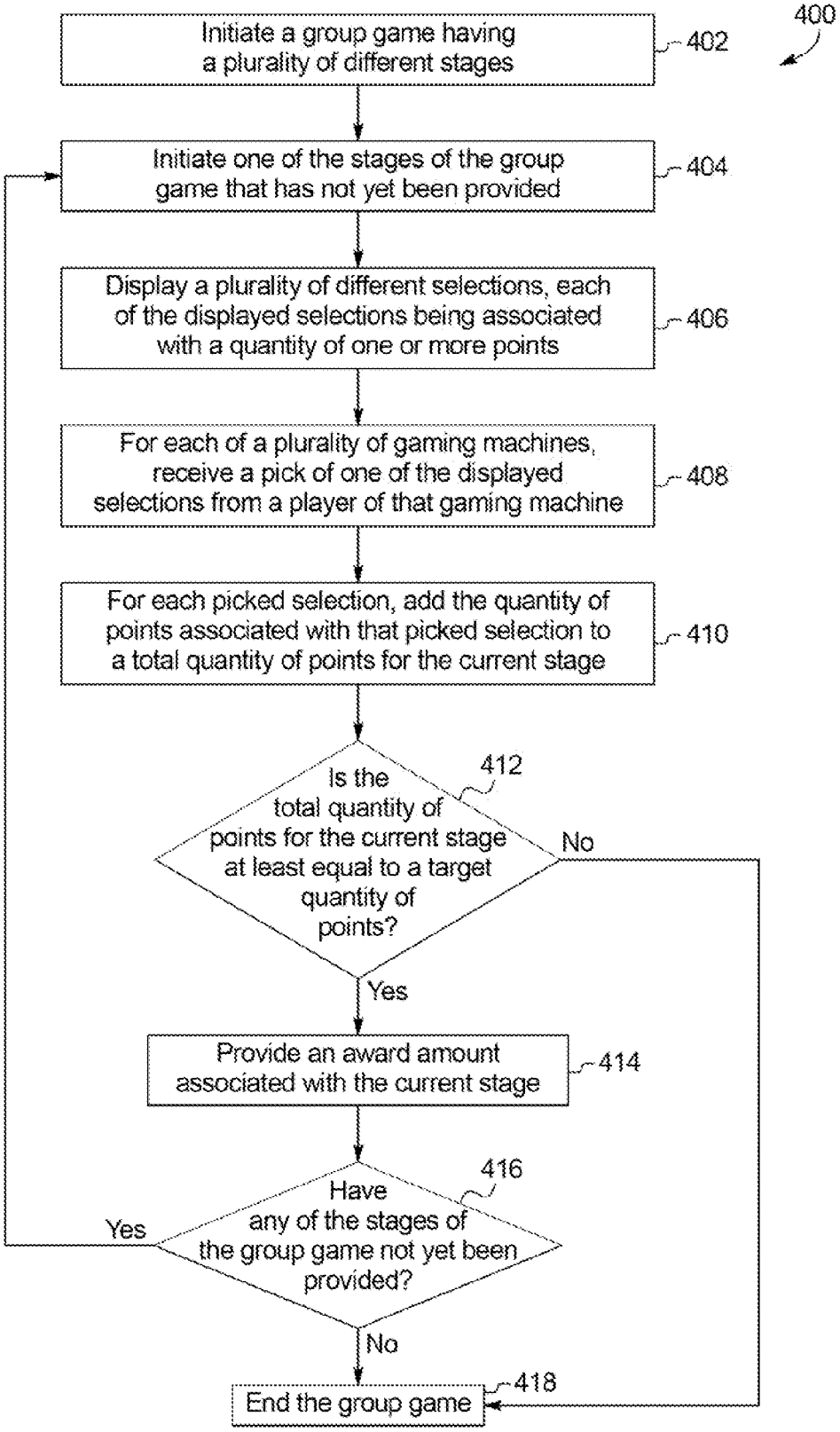
FIG. 3 is a flowchart illustrating an example method of operating another embodiment of the gaming system of the present disclosure.

FIG. 3 illustrates a flowchart of an example process or method 400 of operating another embodiment of the gaming system of the present disclosure. In various embodiments, the process 400 is represented by a set of instructions stored in one or more memories and executed by one or more processors. Although the process 400 is described with reference to the flowchart shown in FIG. 3, it should be appreciated that many other processes of performing the acts associated with this illustrated process 400 may be employed. For example, the order of certain of the illustrated blocks and/or diamonds may be changed, certain of the illustrated blocks and/or diamonds may be optional, and/or certain of the illustrated blocks and/or diamonds may not be employed.

In operation of this example embodiment, the gaming system initiates a group game having a plurality of different stages, as indicated by block 402. The gaming system initiates one of the stages of the group game that has not yet been provided, as indicated by block 404. The gaming system displays a plurality of different selections, as indicated by block 406. In this example embodiment, each of the displayed selections is associated with a quantity of one or more points. For each of a plurality of gaming machines, the gaming system receives a pick of one of the displayed selections from a player of that gaming machine, as indicated by block 408. For each picked selection, the gaming system adds the quantity of points associated with that picked selection to a total quantity of points for the current stage, as indicated by block 410.

The gaming system determines whether the total quantity of points for the current stage is at least equal to a target quantity of points, as indicated by diamond 412. Put differently, the gaming system determines whether the players accumulated at least the target quantity of points during the current stage. If the gaming system determines that the total quantity of points for the current stage is not at least equal to (i.e., is less than) the target quantity of points, the gaming system ends the group game, as indicated by block 418. If, on the other hand, the gaming system determines that the total quantity of points for the current stage is at least equal to (i.e., is greater than or equal to) the target quantity of points, the gaming system provides an award amount associated with the current stage to one or more of the players, as indicated by block 414.

The gaming system determines whether any of the stages of the group game have not yet been provided (i.e., determines whether any of the stages of the group game remain unplayed). If the gaming system determines that all of the stages of the group game have been provided, the gaming system ends the group game, as indicated by block 418. If, on the other hand, the gaming system determines that at least one of the stages of the group game has not yet been provided (i.e., determines that at least one of the stages of the group game remains unplayed), the process 400 returns to block 404 and the gaming system initiates an unplayed stage of the group game.

FIGS. 4A, 4B, 4C, 4D, 4E, and 4F illustrate screenshots of a play of an example embodiment of the group game of the present disclosure according to the process 400. In this example embodiment, the group game is implemented as a bonus game. The group game includes five stages—a first stage, a second stage, a third stage, a fourth stage, and a fifth stage—and is played by players of four different EGMs. More specifically, in this example embodiment, the players of the group game include: (a) Joe, who plays an EGM having a display 1116*a*; (b) Dan, who plays an EGM having a display 1116*b*; (c) Alyssa, who plays an EGM having a display 1116*c*; and (d) Nick, who plays an EGM having a display 1116*d*.

Generally, in this example embodiment, the gaming system provides the first stage upon initiation of the group game (such as upon an occurrence of a bonus triggering event in association with a primary wagering game). In the first stage, the gaming system enables each player to pick one of a first plurality of selections, each of which is associated with a quantity of one or more points. If a total quantity of points associated with the picked selections at least equals a target quantity of points (i.e., if the players accumulated at least the target quantity of points during the first stage), the first stage is won and the gaming system: (a) provides each of the players an award amount associated with the first stage, (b) ends the first stage, and (c) initiates the second stage. If the total quantity of points associated with the picked selections is not at least equal to the target quantity of points (i.e., if the players did not accumulate at least the target quantity of points associated with the first round), the gaming system ends the group game. The gaming system provides the second, third, and fourth stages (if applicable) in a similar manner.

Generally, in this example embodiment, in the fifth (and final) stage, the gaming system enables each player to pick one of a fifth plurality of selections, each of which is associated with a quantity of one or more points. If a total quantity of points associated with the picked selections at least equals a target quantity of points, the fifth stage is won and the gaming system: (a) provides each of the players an award amount associated with the fifth stage, and (b) ends the group game. If the total quantity of points associated with the picked selections is not at least equal to the target quantity of points, the gaming system ends the group game.

It should be appreciated that since each stage of the group game in this example embodiment is won when the total quantity of points associated with the picked selections is at least equal to the target quantity of points associated with the stage, the likelihood of winning a given stage increases as the number of players participating in the group game increases. In other words, for: (a) for a particular number of selections, (b) particular quantities of points associated with the selections, (c) a particular target quantity of points, and (d) a particular quantity of picks per player, the stage is more likely to be won if more players participate in the group game because the total number of picks that the players actually collectively use in the stage increases as the number of players increases. For instance, in this example embodiment, the total number of picks that the players actually collectively use in the first stage is four. If only two players were participating in the group game, however, the total number of picks that those players actually collectively use in the first stage would be two, making it less likely that the players would accumulate at least the target quantity of points to win the first stage. Conversely, if six players were participating in the group game, the total number of picks that those players actually collectively use in the first stage would be six, making it more likely that the players would accumulate at least the target quantity of points to win the first stage.

Figure 4A:
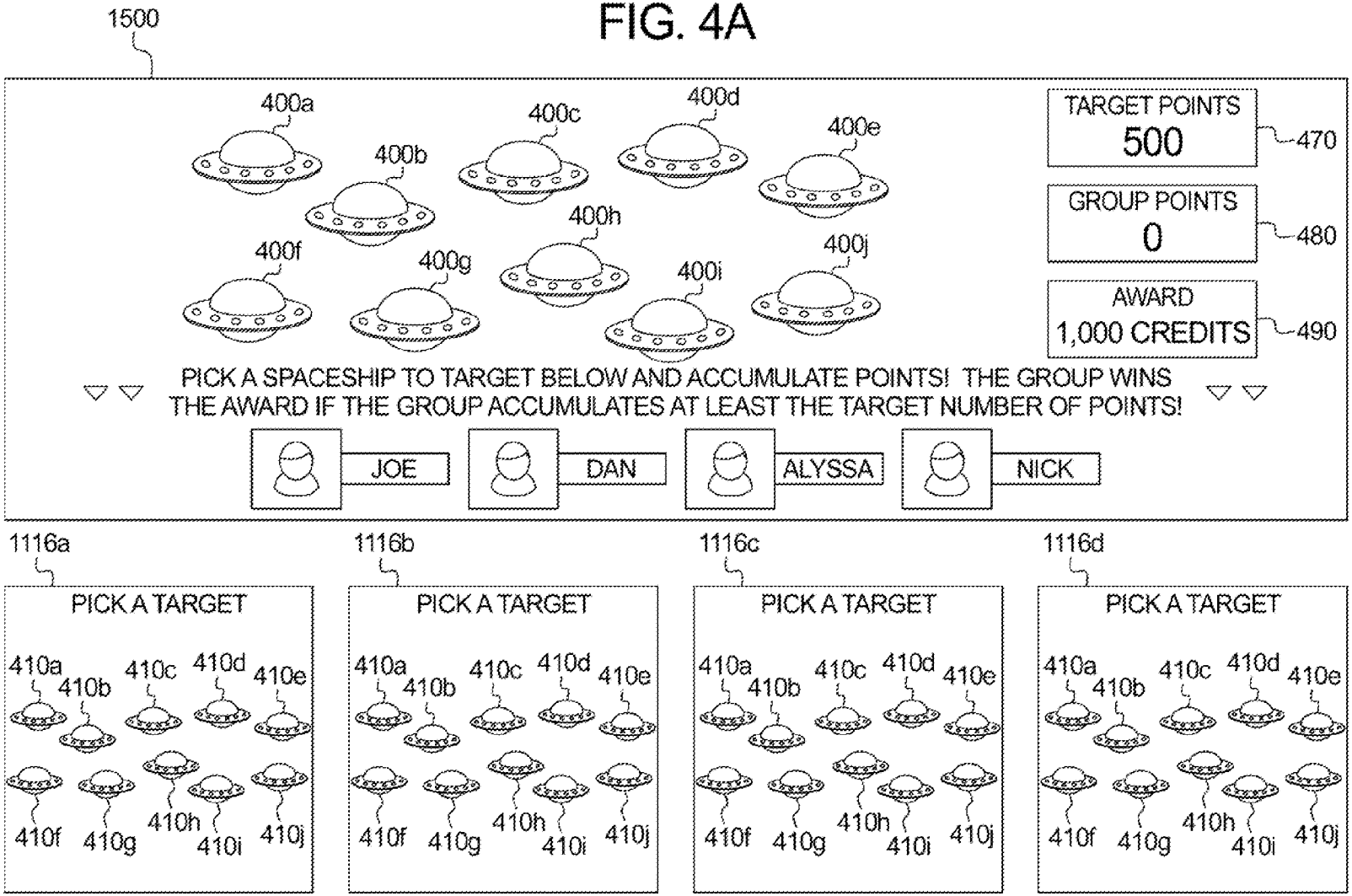
FIGS. 4A, 4B, 4C, 4D, 4E, and 4F illustrate screenshots of a play of another example embodiment of the group game of the present disclosure.
Figure 4B:
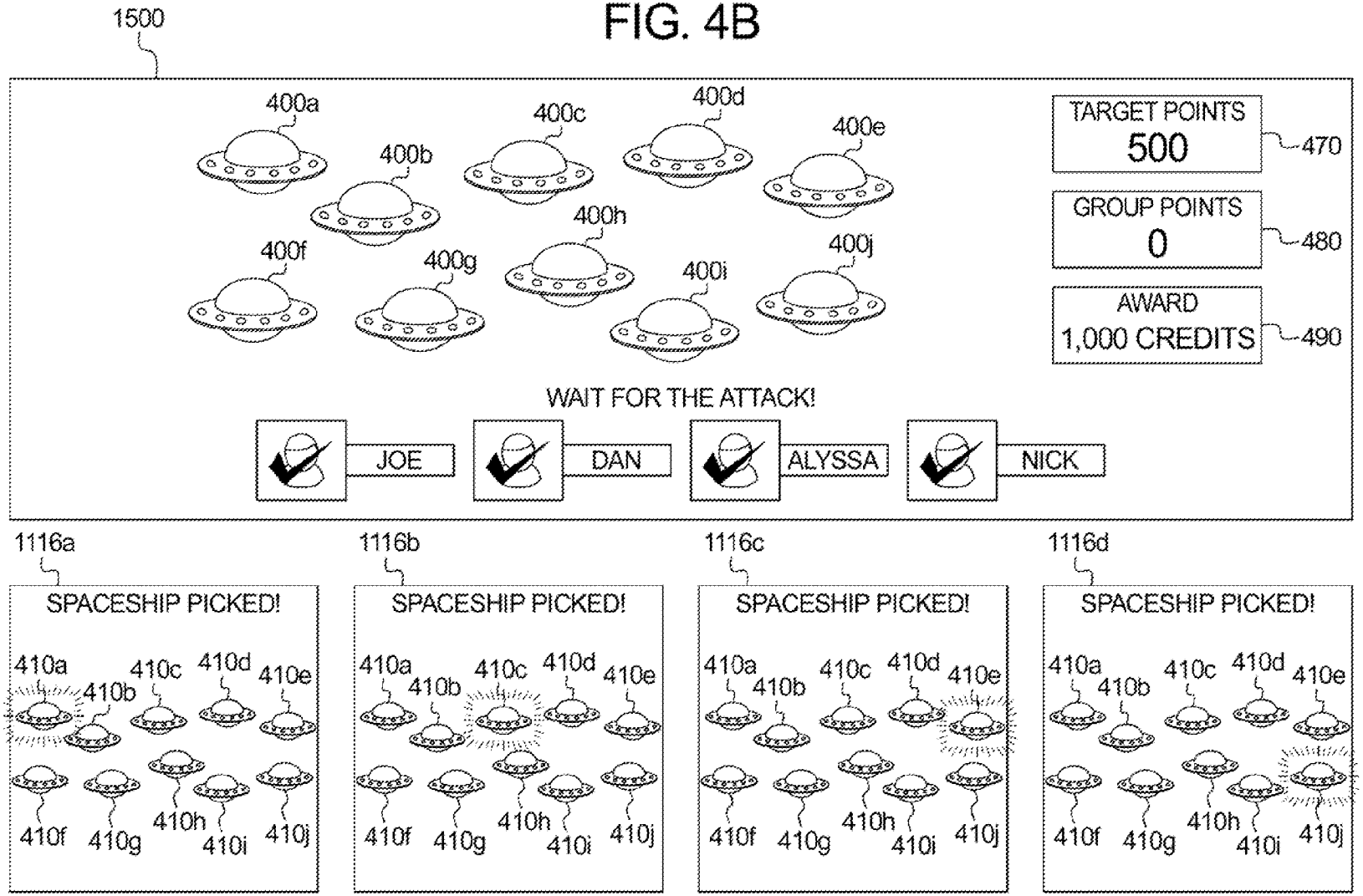

Turning to FIG. 4A, upon triggering the group game, the gaming system initiates the first stage of the group game. For the first stage of the group game, in this example embodiment, the gaming system displays on the shared display 1500: (a) a plurality of spaceships 400*a*, 400*b*, 400*c*, 400*d*, 400*e*, 400*f*, 400*g*, 400*h*, 400*i*, and 400*j*; (b) a target points meter 470 that displays a target quantity of 500 points associated with the first stage; (c) a group points meter 480 that displays a total quantity of points accumulated by the players in the first stage; and (d) an award meter 490 that displays an award of 1,000 credits associated with the first stage of the group game. Additionally, the gaming system displays a plurality of selections 410*a*, 410*b*, 410*c*, 410*d*, 410*e*, 410*f*, 410*g*, 410*h*, 410*i*, and 410*j* on each of the displays 1116*a*, 1116*b*, 1116*c*, and 1116*d* of the players' EGMs. The selections 410*a*, 410*b*, 410*c*, 410*d*, 410*e*, 410*f*, 410*g*, 410*h*, 410*i*, and 410*j* are respectively associated with the spaceships 400*a*, 400*b*, 400*c*. 400*d*, 400*e*, 400*f*, 400*g*, 400*h*, 400*i*, and 400*j*. In this example embodiment, the gaming system associates each of the selections (and each associated spaceship) with a quantity of points (not shown). The gaming system enables each of the players to pick one of the selections.

Figure 4C:
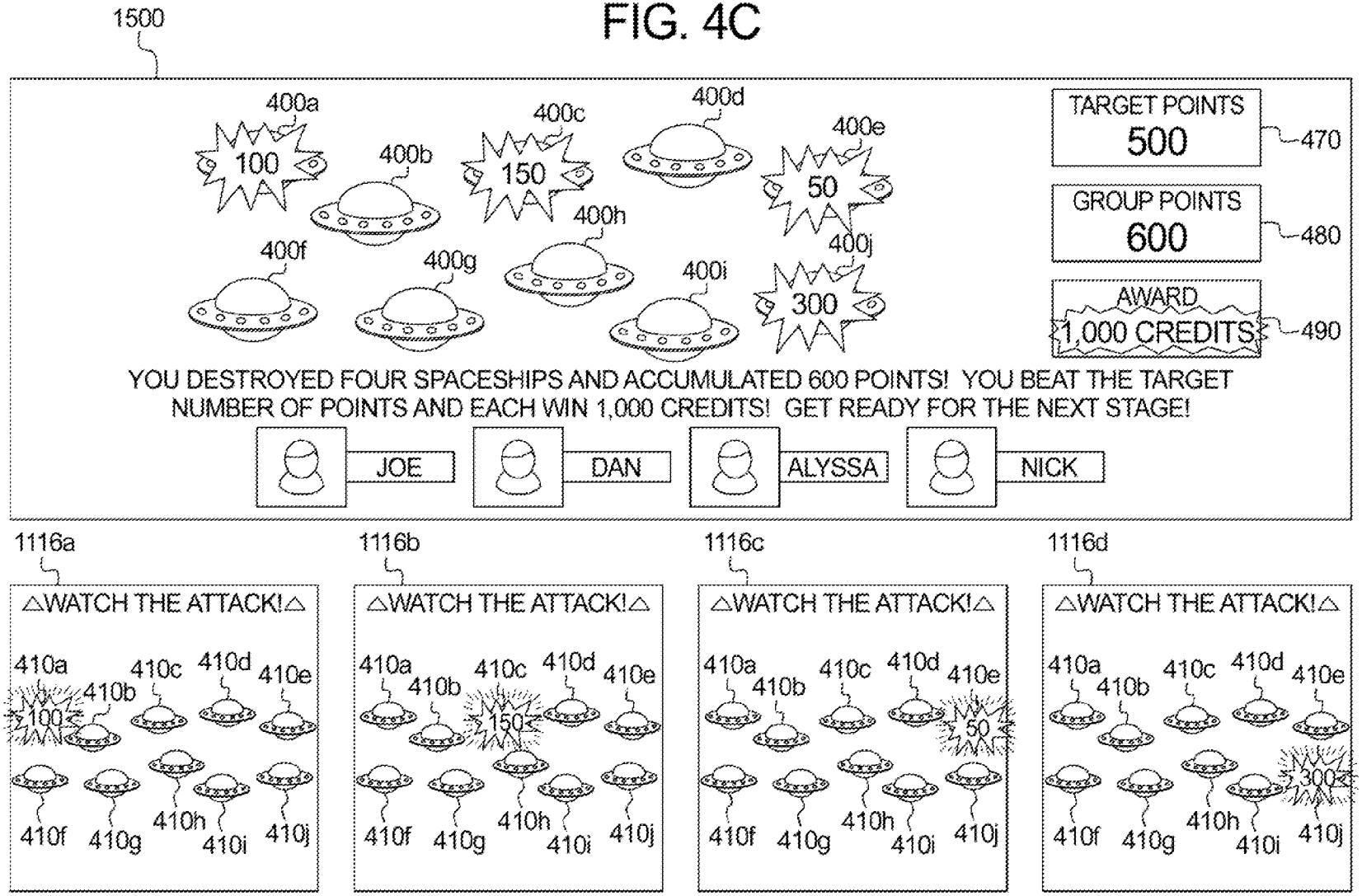

As illustrated in FIG. 48, the gaming system receives: (a) a pick of the selection 410*a* from Joe, (b) a pick of the selection 410*c* from Dan, (c) a pick of the selection 410*e* from Alyssa, and (d) a pick of the selection 410*j* from Nick. As shown in FIG. 4C, the gaming system displays the quantity of points associated with the spaceship associated with each picked selection. More specifically, the gaming system displays: (a) the quantity of 100 points associated with the picked selection 410*a* (and the spaceship 400*a*), (*b*) the quantity of 150 points associated with the picked selection 410*c* (and the spaceship 400*c*), (*c*) the quantity of 50 points associated with the picked selection 410*e* (and the spaceship 400*e*), and (*d*) the quantity of 300 points associated with the picked selection 410*j* (and the spaceship 400*j*).

The gaming system sums the quantities of points associated with the picked spaceships and displays the total quantity of 600 points accumulated by the players during the first stage in the group points meter 480. The gaming system determines that the total quantity of 600 points accumulated by the players during the first stage is greater than (i.e., is at least equal to) the target quantity of 500 points associated with the first stage of the group game. Accordingly, the gaming system: (a) provides the 1,000 credit award to each of the players, (b) ends the first stage of the group game, and (c) initiates the second stage of the group game.

Figure 4D:
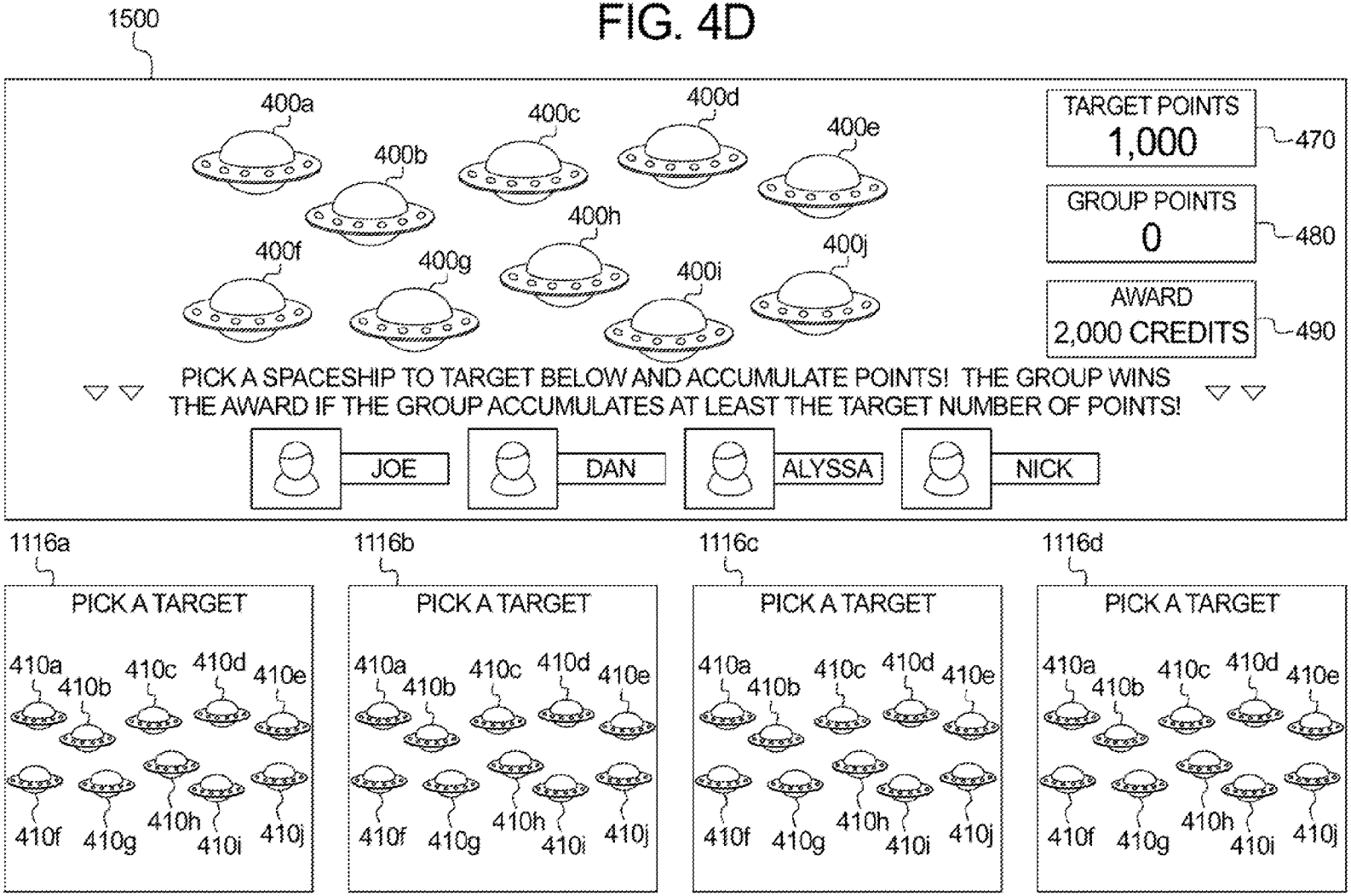

As illustrated in FIG. 4D, for the second stage of the group game, the gaming system displays on the shared display 1500: (a) the plurality of spaceships 400*a*, 400*b*, 400*c*, 400*d*, 400*e*, 400*f*, 400*g*, 400*h*, 400*i*, and 400*j*; (b) the target points meter 470 that displays a target quantity of 1,000 points associated with the second stage; (c) the group points meter 480; and (d) the award meter 490 that displays an award of 2,000 credits associated with the second stage of the group game. Additionally, the gaming system displays the plurality of selections 410*a*, 410*b*, 410*c*, 410*d*, 410*e*, 410*f*, 410*g*, 410*h*, 410*i*, and 410*j* on each of the displays 1116*a*, 1116*b*, 1116*c*, and 1116*d* of the players' EGMs. The selections 410*a*, 410*b*. 410*c*, 410*d*, 410*e*, 410*f*, 410*g*, 410*h*, 410*i*, and 410*j* are respectively associated with the spaceships 400*a*, 400*b*. 400*c*, 400*d*, 400*e*, 400*f*, 400*g*, 400*h*, 400*i*, and 400*j*. In this example embodiment, the gaming system associates each of the selections (and each associated spaceship) with a quantity of points (not shown). The gaming system enables each of the players to pick one of the selections.

Figure 4E:
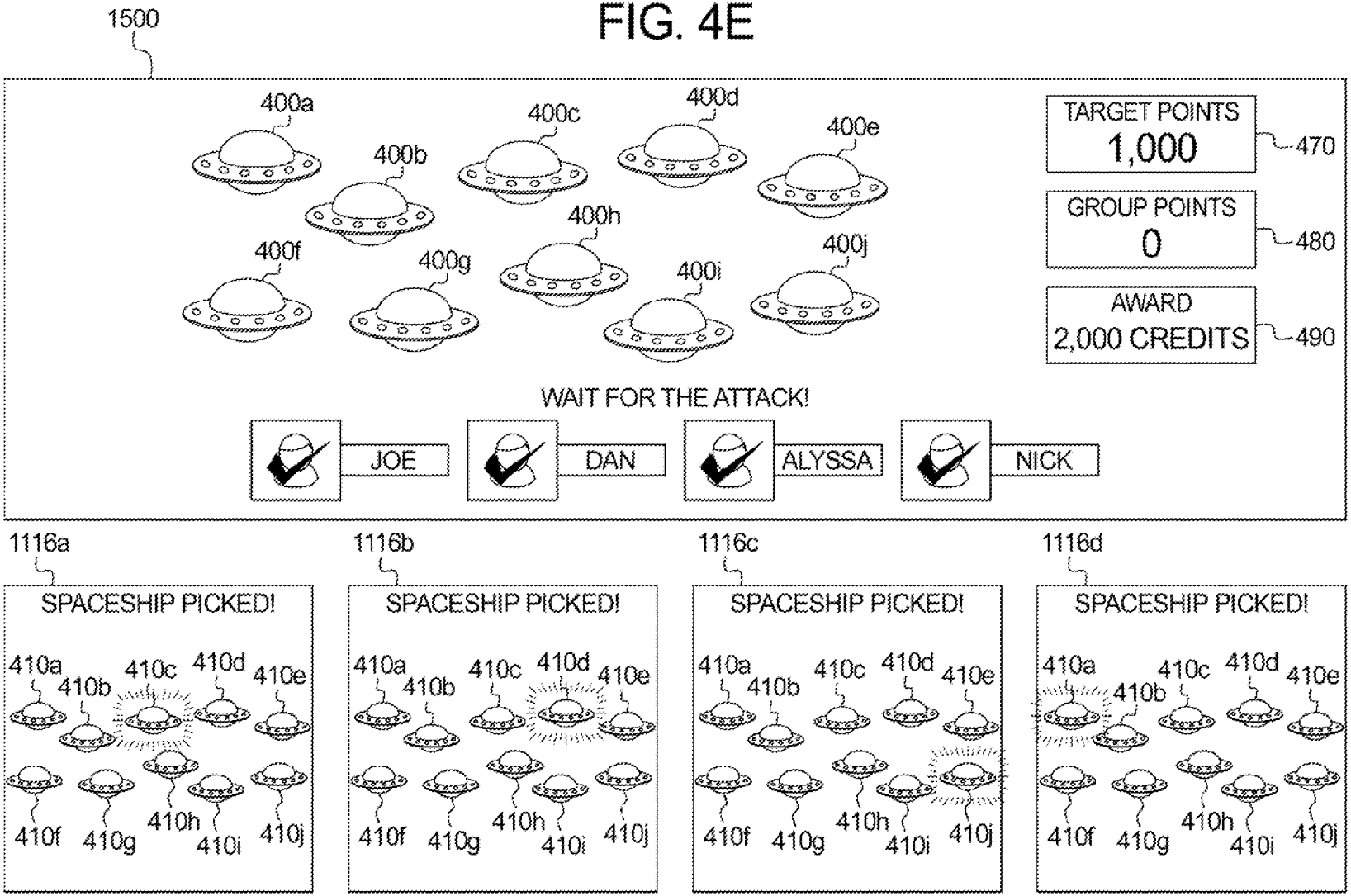
Figure 4F:
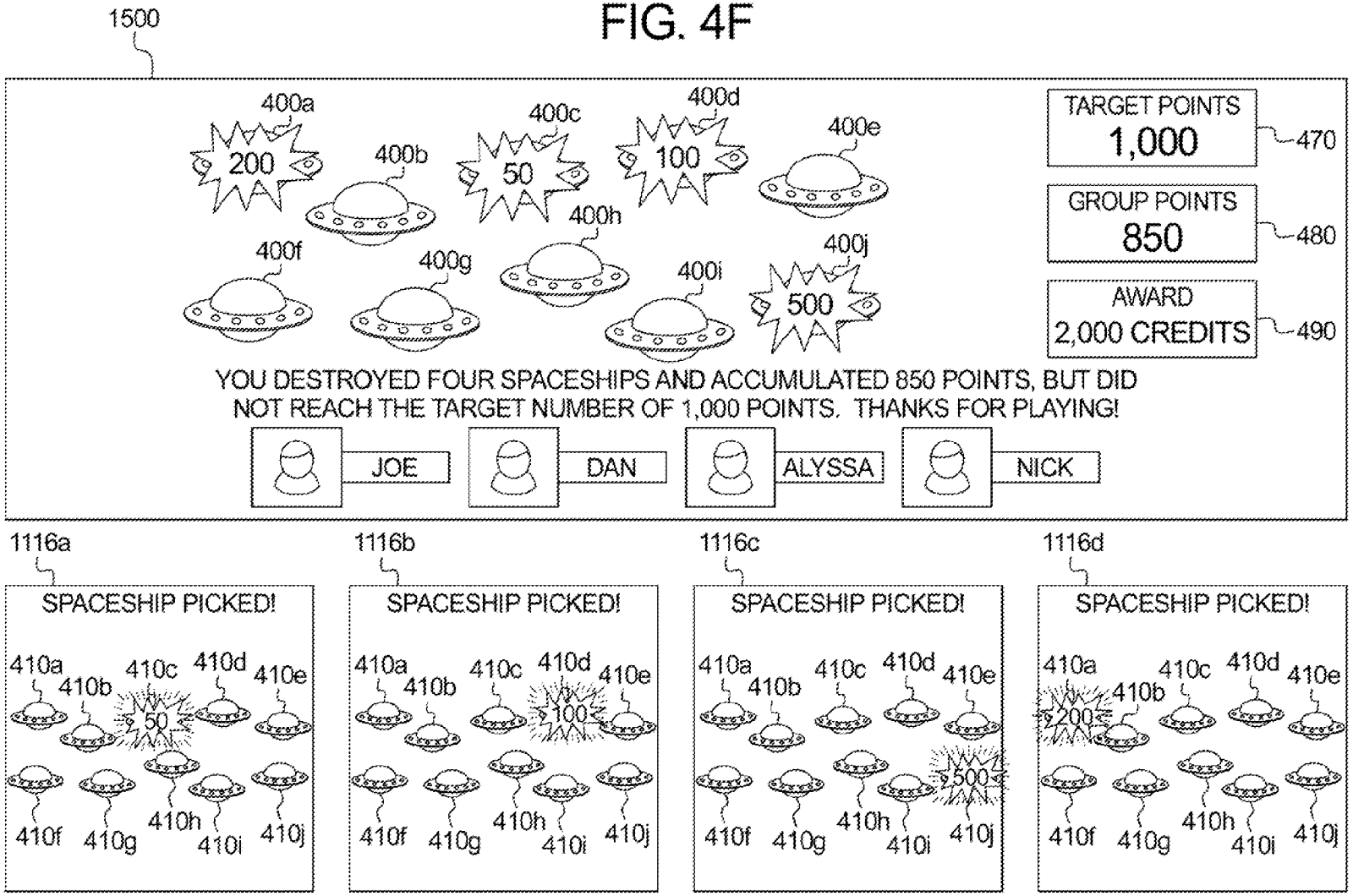

As illustrated in FIG. 4E, the gaming system receives: (a) a pick of the selection 410*c* from Joe, (b) a pick of the selection 410*d* from Dan, (c) a pick of the selection 410*j* from Alyssa, and (d) a pick of the selection 410*a* from Nick. As shown in FIG. 4F, the gaming system displays the quantity of points associated with the spaceship associated with each picked selection. More specifically, the gaming system displays: (a) the quantity of 50 points associated with the picked selection 410*c* (and the spaceship 400*c*), (*b*) the quantity of 100 points associated with the picked selection 410*d* (and the spaceship 400*d*), (*c*) the quantity of 500 points associated with the picked selection 410*j* (and the spaceship 400*j*), and (*d*) the quantity of 200 points associated with the picked selection 410*a* (and the spaceship 400*a*).

The gaming system sums the quantities of points associated with the picked spaceships and displays the total quantity of 850 points accumulated by the players during the second stage in the group points meter 480. The gaming system determines that the total quantity of 850 points accumulated by the players during the second stage is less than (i.e., is not at least equal to) the target quantity of 1,000 points associated with the second stage of the group game. Accordingly, the gaming system ends the group game.

In certain embodiments, the gaming system associates one or more of the selections with additional awards. In one such embodiment, when the gaming system receives a pick of one such selection from a player, the gaming system provides the player the additional award associated with the picked selection. In another such embodiment, when the gaming system receives a pick of one such selection from a player, the gaming system provides each of the players the additional award associated with the picked selection. In another such embodiment, when the gaming system receives a pick of one such selection from a player, the gaming system provides a portion of the additional award (such as an equal portion of the additional award) associated with the picked selection to each of the players.

In various embodiments, when a stage is won, the gaming system provides the award associated with the stage to each of the players. In other embodiments, when a stage is won, the gaming system provides the award associated with the stage to the player(s) who picked the selection(s) that resulted in the stage being won. In further embodiments, when a stage is one, the gaming system provides a portion of the award (such as an equal portion of the award) to each of the players.

In certain embodiments, the award amounts associated with the stages increase as the players progress through different stages. For example, the award amount associated with a first stage is 500 credits; the award amount associated with a second stage is 1,000 credits; and the award amount associated with a third and final stage is 2,000 credits.

In various embodiments, the target quantity of points increases as the players progress through different stages. For instance, the target quantity of points associated with a first stage is 500 points; the target quantity of points associated with a second stage is 1,000 points; and the target quantity of points associated with a third and final stage is 2,000 points.

Generally, the average expected total payback percentage of the group game, which is the average percentage of money wagered on the primary wagering game that is paid back to the players during the group game, is determined by: (a) the awards available to be won in the group game, and (b) the probability that such awards will be won in the group game. Thus, modifying: (a) the awards available to be won in the group game, or (b) the probability that such awards will be won in the group game will, in certain instances, change the average expected total payback percentage of the group game. For example, lowering the probability that an award will be won in the group game without modifying the awards available to be won in the group game will lower the average expected total payback percentage of the group game, and vice-versa. Further, lowering an amount of one of the awards available to be won in the group game without modifying the probability that any awards will be won in the group game will lower the average expected total payback percentage of the group game, and vice-versa.

In other instances, modifying both: (a) the awards available to be won in the group game, and (b) the probability that such awards will be won in the group game in certain manners will, in certain instances, not change or substantially change the average expected total payback percentage of the group game but will change one or more features of the group game. For example, lowering the probability that an award will be won in the group game while also increasing the amount that award in a corresponding manner will not change or substantially change the average expected total payback percentage of the group game, but makes that award more difficult to win and more lucrative when won. Conversely, increasing the probability that an award will be won in the group game while also decreasing the amount of that award in a corresponding manner will not change or substantially change the average expected total payback percentage of the group game, but will make that award easier to win and less lucrative when won.

In certain embodiments, the average expected total payback percentage of the group game does not change or substantially change (e.g., falls within a designated range of average expected total payback percentages) based on the number of players participating in the group game. In other words, in these embodiments, the gaming system ensures that the number of players participating in the group game does not impart an advantage or a substantial advantage in the group game. It should also be appreciated that, in certain such embodiments, for a play of the group game, the average expected payout for each player participating in that play of the group game is the same or substantially the same.

In various embodiments, the gaming system determines or sets one or more characteristics, features, or parameters of the group game based on the number of players participating in the group game such that the average expected total payback percentage of the group game is the same or substantially the same for each play of the group game regardless of the number of players participating in that play of the group game. Thus, in these embodiments, upon initiation of a play of the group game, the gaming system determines the number of players participating in the group game and then sets the one or more characteristics, features, or parameters of the group game based on the determined number of players participating in the group game such that the average expected total payback percentage of the group game is a designated average expected payback percentage.

In various embodiments, the gaming system determines or sets the award associated with a stage of the group game based on the number of players participating in the group game such that the average expected total payback percentage of the group game is the same or substantially the same regardless of the number of players participating in the group game. Here, for a given stage of the group game, as the number of players participating in the group game increases, the total number of picks that those players actually collectively use during the stage increases, which increases the probability that those players will accumulate at least the target quantity of points associated with the stage and win the stage (and its associated award). Accordingly, in these embodiments, as the number of players participating in the group game increases, the gaming system determines lower awards associated with the stage to offset the higher probability that the players participating in the group game will accumulate at least the target quantity of points associated with the stage and win the stage (and its associated award), thereby maintaining a desired average expected total payback percentage for the group game.

Conversely, for a given stage of the group game, as the number of players participating in the group game decreases, the total number of picks that those players actually collectively use during the stage decreases, which decreases the probability that those players will accumulate at least the target quantity of points associated with the stage and win the stage (and its associated award). Accordingly, in these embodiments, as the number of players participating in the group game decreases, the gaming system determines higher awards associated with the stage to compensate for the lower probability that the players participating in the group game will accumulate at least the target quantity of points associated with the stage and win the stage (and its associated award), thereby maintaining a desired average expected total payback percentage for the group game.

Thus, in these embodiments, for a given stage: (a) when a relatively small number of players are participating in the group game, those players have a relatively low probability of winning the stage, which is associated with a relatively large award; and (b) when a relatively large number of players are participating in the group game, those players have a relatively high probability of winning the stage, which is associated with a relatively small award. For example: (a) if two players are participating in the group game, those players have a 10% probability of winning the first stage, and the gaming system determines an award of 1,000 credits associated with the first stage; (b) if four players are participating in the group game, those players have a 20% probability of winning the first stage, and the gaming system determines an award of 500 credits associated with the first stage; and (c) if eight players are participating in the group game, those players have a 40% probability of winning the first stage, and the gaming system determines an award of 250 credits associated with the first stage.

In certain embodiments, the gaming system determines or sets the target quantity of points based on the number of players participating in the group game such that the average expected total payback percentage of the group game is the same or substantially the same regardless of the number of players participating in the group game. Here, for a given stage of the group game and for a given target quantity of points, as the number of players participating in the group game increases, the total number of picks that those players actually collectively use during the stage increases, which increases the probability that those players will accumulate at least the target quantity of points associated with the stage and win the stage (and its associated award). Accordingly, in these embodiments, as the number of players participating in the group game increases, the gaming system determines higher target quantities of points to maintain a desired probability that the players participating in the group game accumulate at least the target quantity of points associated with the stage and win the stage (and its associated award), thereby maintaining a desired average expected total payback percentage for the group game.

Conversely, for a given stage of the group game and for a given target quantity of points, as the number of players participating in the group game decreases, the total number of picks that those players actually collectively use during the stage decreases, which decreases the probability that those players will accumulate at least the target quantity of points associated with the stage and win the stage (and its associated award). Accordingly, in these embodiments, as the number of players participating in the group game decreases, the gaming system determines lower target quantities of points to maintain a desired probability that the players participating in the group game accumulate at least the target quantity of points associated with the stage and win the stage (and its associated award), thereby maintaining a desired average expected total payback percentage for the group game.

Thus, in these embodiments, for a given stage, the players participating in the group game have the same or substantially the same probability (i.e., the desired probability) of winning the stage (and its associated award) regardless of the number of players participating in the group game. For example: (a) if two players are participating in the group game, the gaming system determines a target quantity of 200 points and, therefore, those players have a 40% probability of winning the first stage; (b) if four players are participating in the group game, the gaming system determines a target quantity of 400 points and, therefore, those players also have a 40% probability of winning the first stage; and (c) if eight players are participating in the group game, the gaming system determines a target quantity of 800 points and, therefore, those players have a 40% probability of winning the first stage.

In various embodiments in which the gaming system associates each of one or more of the selections with an additional award, the gaming system determines or sets: (a) the quantity of selections associated with additional awards, and/or (b) the amount of such additional awards based on the number of players participating in the group game such that the average expected total payback percentage of the group game is the same or substantially the same regardless of the number of players participating in the group game. Here, for a given stage of the group game, as the number of players participating in the group game increases, the total number of picks that those players actually collectively use during the stage increases, which increases the probability that those players will accumulate at least the target quantity of points associated with the stage and win the stage (and its associated award). Accordingly, in these embodiments, as the number of players participating in the group game increases, the gaming system determines: (a) lower quantities of selections associated with additional awards, and/or (b) lower amounts of such additional awards to offset the higher probability that the players participating in the group game will accumulate at least the target quantity of points associated with the stage and win the stage (and its associated award), thereby maintaining a desired average expected total payback percentage for the group game.

Conversely, for a given stage of the group game, as the number of players participating in the group game decreases, the total number of picks that those players actually collectively use during the stage decreases, which decreases the probability that those players will accumulate at least the target quantity of points associated with the stage and win the stage (and its associated award). Accordingly, in these embodiments, as the number of players participating in the group game decreases, the gaming system determines: (a) higher quantities of selections associated with additional awards, and/or (b) higher amounts of such additional awards to offset the lower probability that the players participating in the group game will accumulate at least the target quantity of points associated with the stage and win the stage (and its associated award), thereby maintaining a desired average expected total payback percentage for the group game.

Thus, in these embodiments, for a given stage: (a) when a relatively small number of players are participating in the group game, those players: (i) have a relatively high probability of picking a selection associated with an additional award, and/or (ii) win a relatively large additional award after picking a selection associated with an additional award; and (b) when a relatively large number of players are participating in the group game, those players: (i) have a relatively low probability of picking a selection associated with an additional award, and/or (ii) win a relatively low additional award after picking a selection associated with an additional award. For example: (a) if two players are participating in the group game, the gaming system associates four selections with an additional award of 40 credits; (b) if four players are participating in the group game, the gaming system associates two selections with an additional award of 20 credits; and (c) if eight players are participating in the group game, the gaming system associates one selection with an additional award of 10 credits.

As noted above with respect to the first example embodiment, it should be appreciated that while the above-described example embodiments vary the award amounts, the probabilities, and/or any other suitable feature(s) employed for a play of the group game such that the average expected total payback percentage of the group game does not change or substantially change based on the number of players participating in the group game, in other embodiments the gaming system modifies the weightings of a weighted table used to determine any such feature(s).

It should be appreciated that:

(a) how the group game is triggered;
(b) the number of players participating in the group game;
(c) the quantity of stages;
(d) the quantity of selections;
(e) the theme of the group game;
(f) the award associated with each stage;
(g) the target quantity of points for each stage;
(h) whether the gaming system enables sequential or simultaneous picking of selections;
(i) whether the gaming system enables players to see other players' picks;
(j) the manner or manners in which the gaming system ensures that the average expected total payback percentage of the group game is the same or substantially the same regardless of the number of players participating in the group game;
(k) the number of picks per player per stage; and/or
(l) any other variables or determinations described herein may be: (1) predetermined; (2) randomly determined; (3) randomly determined based on one or more weighted percentages (such as according to a weighted table); (4) determined based on a generated symbol or symbol combination; (5) determined independent of a generated symbol or symbol combination: (6) determined based on a random determination by a central controller (described below); (7) determined independent of a random determination by the central controller; (8) determined based on a random determination at an electronic gaming machine (EGM) configured to operate the slot game (described below); (9) determined independent of a random determination at the EGM; (10) determined based on at least one play of at least one game; (11) determined independent of at least one play of at least one game; (12) determined based on a player's selection; (13) determined independent of a player's selection; (14) determined based on one or more side wagers placed; (15) determined independent of one or more side wagers placed; (16) determined based on the players primary game wager or wager level; (17) determined independent of the player's primary game wager or wager level; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (i.e., a player tracking status); (23) determined independent of a status of the player (i.e., a player tracking status); (24) determined based on one or more other determinations disclosed herein; (25) determined independent of any other determination disclosed herein; and/or (26) determined in any other suitable manner or based on or independent of any other suitable factor(s).

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs;

and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 5A:
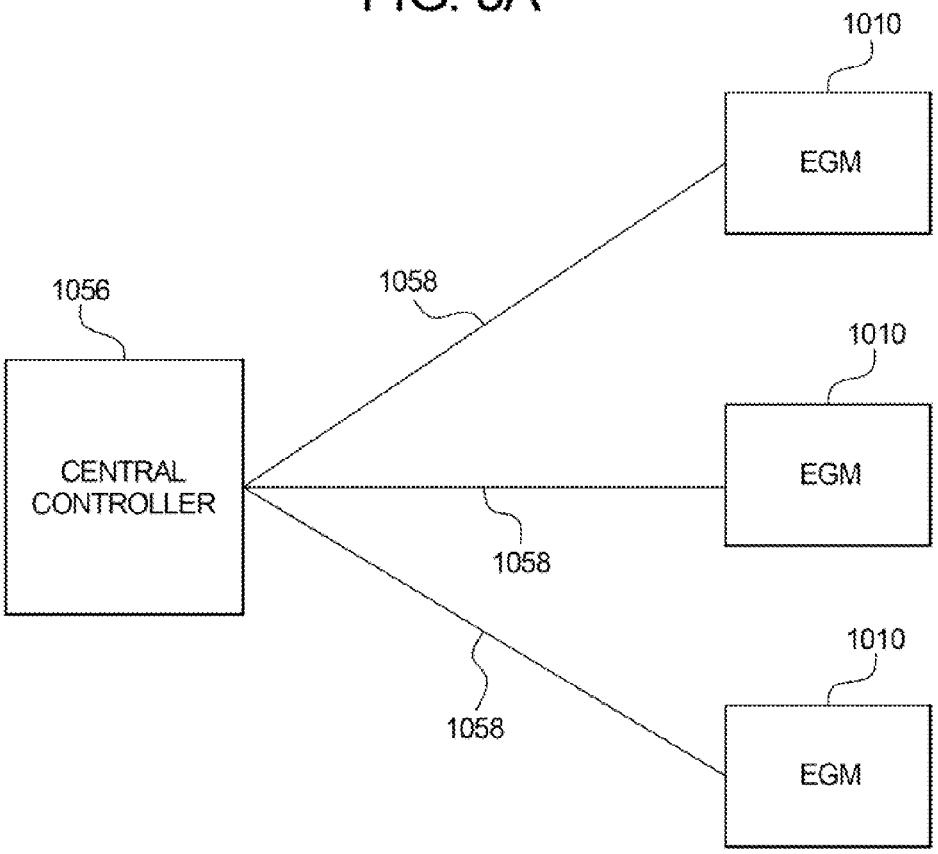
FIG. 5A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 5A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 5B:
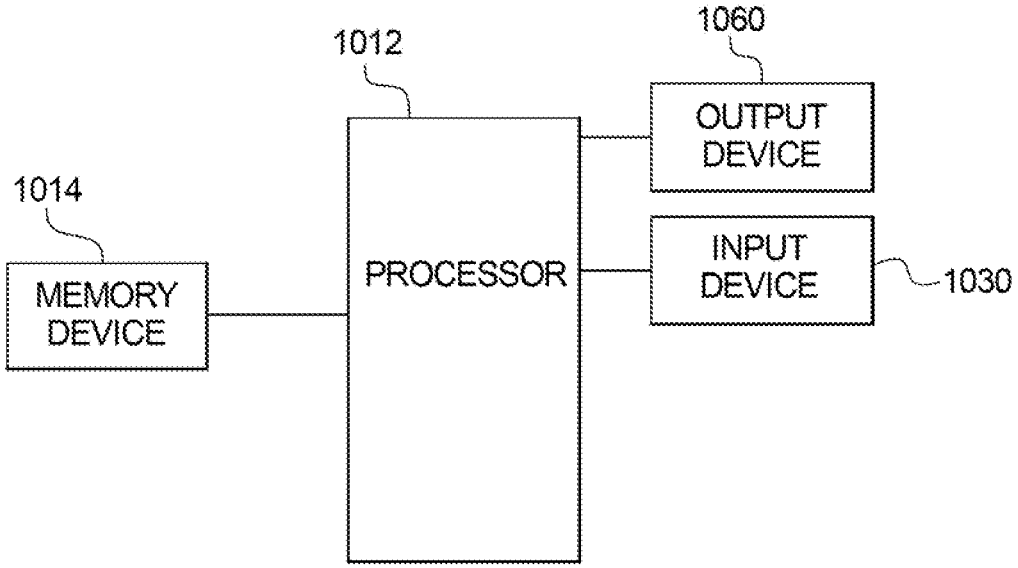
FIG. 5B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 5B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 5B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 6A:
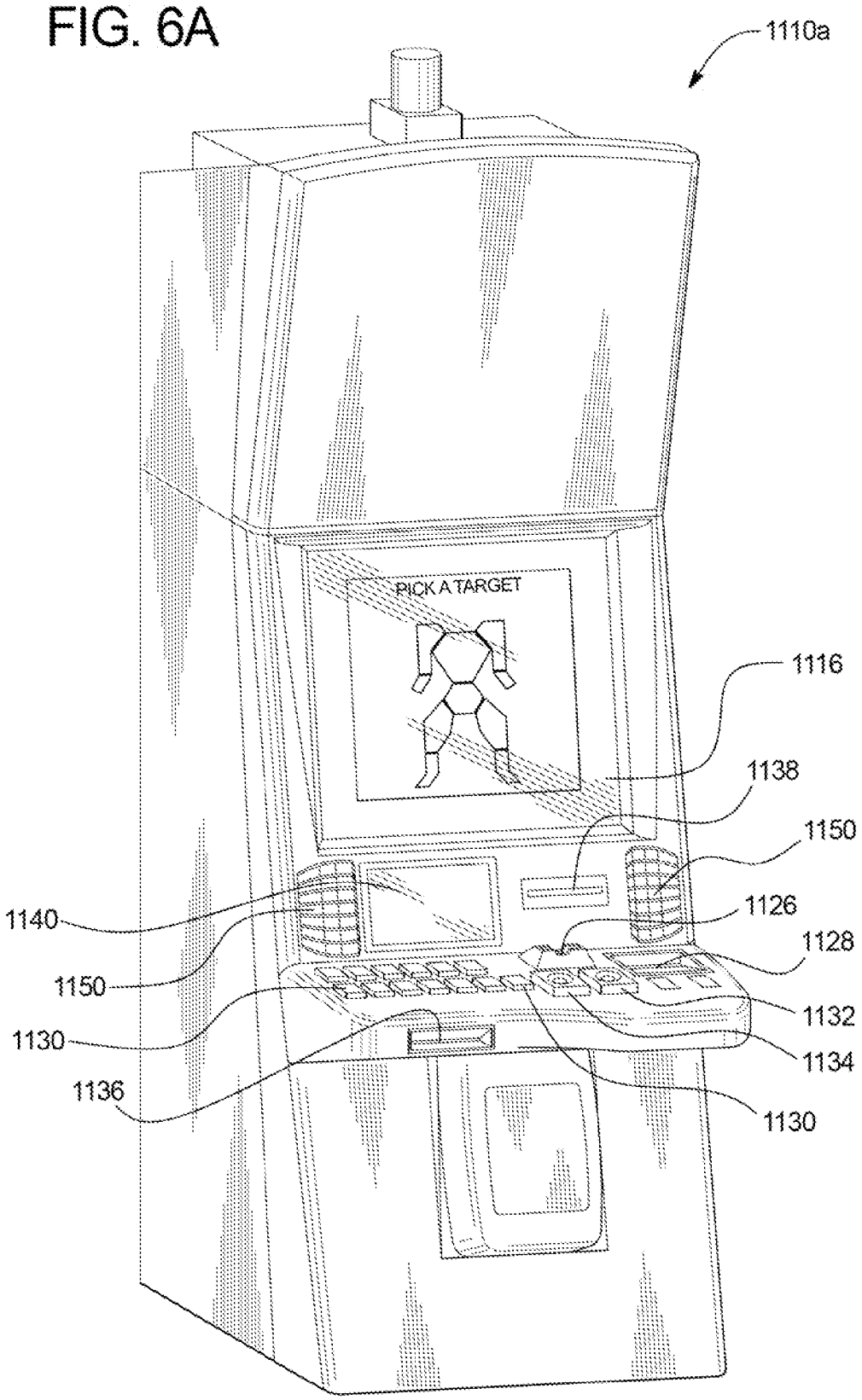
FIGS. 6A and 6B are perspective views of example alternative embodiments of the gaming system of the present disclosure.
Figure 6B:
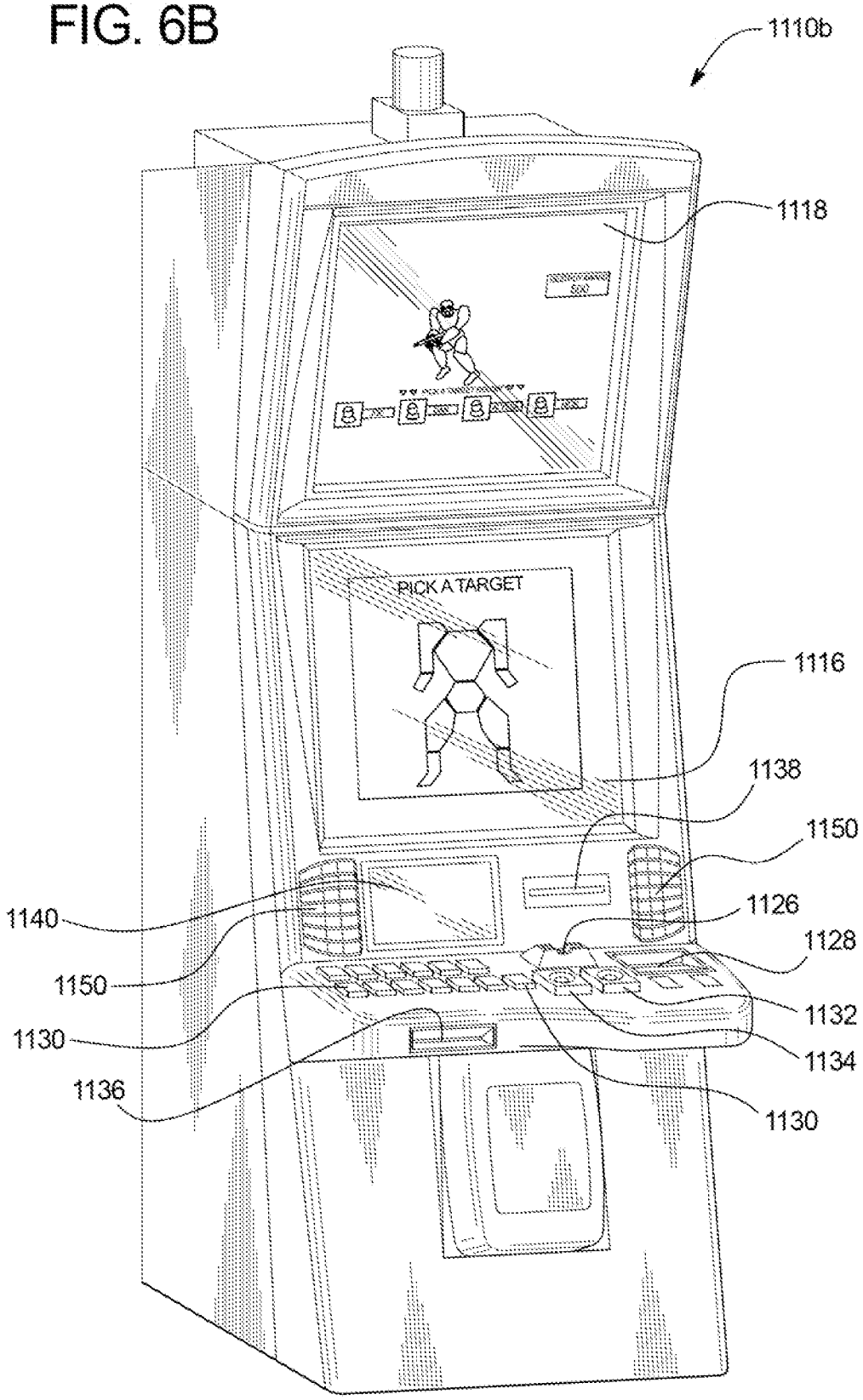

In various embodiments, the EGM includes one or more input devices. The input devices may include any suitable device that enables an input signal to be produced and received by the at least one processor of the EGM. The example EGM illustrated in FIG. 5B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 6A and 6B illustrate example EGMs 1110*a* and 1110*b* that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs 1110*a* and 1110*b* illustrated in FIGS. 6A and 6B each include a game play activation device in the form of a game play initiation button 1132. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one. The example EGMs 1110*a* and 1110*b* illustrated in FIGS. 6A and 6B each include betting devices 1130.

In other embodiments, one input device of the EGM is a cash out device. The cash out device is utilized to receive a cash payment or any other suitable form of payment corresponding to a quantity of remaining credits of a credit display (as described below). The example EGMs 1110*a* and 1110*b* illustrated in FIGS. 6A and 6B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs 1110*a* and 1110*b* illustrated in FIGS. 6A and 6B each include a card reader 1138. The card reader is configured to read a player identification card inserted into the card reader.

In various embodiments, the EGM includes one or more output devices. The example EGM illustrated in FIG. 5B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM 1110*a* illustrated in FIG. 6A includes a central display device 1116 and a player tracking display 1140. The example EGM 1110*b* illustrated in FIG. 6B includes a central display device 1116, an upper display device 1118, a player tracking display 1140, and a player tracking display 1140.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs 1110*a* and 1110*b* illustrated in FIGS. 6A and 6B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs 1110*a* and 1110*b* illustrated in FIGS. 6A and 6B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels. SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs 1110*a* and 1110*b* illustrated in FIGS. 6A and 6B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs 1110*a* and 1110*b* shown in FIGS. 6A and 6B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player: and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 200610094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the players birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a central controller configured to operate with a plurality of gaming machines, each gaming machine including (1) an acceptor configured to receive a physical item associated with a monetary value and to establish a credit balance based at least in part on the monetary value associated with the received physical item, the credit balance usable to wager on a play of a primary game and being decreasable based on any placed wager, and (2) a cashout device actuatable to initiate a payout associated with the credit balance, to:

(a) upon an occurrence of a triggering event in association with at least one wagered-on play of the primary game, provide a group game having a plurality of different stages; and (b) for one of the stages of the group game:

(i) display a plurality of different selections, the displayed selections including at least one designated selection;

(ii) display an initial award amount for said stage;

(iii) for each of the gaming machines, receive a pick of one of the displayed selections from a player of said gaming machine;

(iv) if a target quantity of each of the at least one designated selection has been picked, the target quantity being at least two:

(A) provide the displayed award amount, the credit balance of at least one of the gaming machines being increasable by the displayed award amount; and (B) if at least one of the stages of the group game has not been provided, provide another one of the stages of the group game; and (v) if the target quantity of each of the at least one designated selection has not yet been picked, regardless of whether the at least one designated selection has been picked, reduce the displayed award amount for said stage and repeat (b)(ii) to (b)(v) for said stage for the gaming machines at least once.

2. The gaming system of claim 1, wherein the central controller is configured to operate with the plurality of gaming machines to, for said stage of the group game, repeat (b)(ii) to (b)(v) up to a maximum quantity of times, said maximum quantity being at least two.

3. The gaming system of claim 1, wherein the central controller is configured to operate with the plurality of gaming machines to, for said stage of the group game, if the target quantity of the at least one designated selection has been picked, provide (b)(i) to (b)(v) for said other stage of the group game.

4. The gaming system of claim 3, wherein a displayed initial award amount for said other stage of the group game is greater than the displayed initial award amount for said stage of the group game.

5. The gaming system of claim 1, wherein the central controller is configured to operate with the plurality of gaming machines to, for said stage of the group game, if the target quantity of the at least one designated selection has been picked, provide the displayed award amount by providing at least part of the displayed award amount to each player participating in the group game.

6. The gaming system of claim 1, wherein an average expected total payback percentage of the group game is the same regardless of a number of players participating in the group game.

7. A method of operating a gaming system, said method comprising:

causing a central controller to operate with a plurality of gaming machines, each gaming machine including an acceptor configured to receive a physical item associated with a monetary value and to establish a credit balance based at least in part on the monetary value associated with the received physical item, the credit balance usable to wager on a play of a primary game and being decreasable based on any placed wager, and (2) a cashout device actuatable to initiate a payout associated with the credit balance, to:

(a) upon an occurrence of a triggering event in association with at least one wagered-on play of the primary game, provide a group game having a plurality of different stages; and (b) for one of the stages of the group game:

(i) display a plurality of different selections, the displayed selections including at least one designated selection;

(ii) display an initial award amount for said stage;

(iii) for each of the gaming machines, receive a pick of one of the displayed selections from a player of said gaming machine;

(iv) if a target quantity of each of the at least one designated selection has been picked, the target quantity being at least one:

(A) provide the displayed award amount, the credit balance of at least one of the gaming machines being increasable by the displayed award amount; and (B) if at least one of the stages of the group game has not been provided, provide another one of the stages of the group game; and (v) if the target quantity of each of the at least one designated selection has not yet been picked, regardless of whether the at least one designated selection has been picked, reduce the displayed award amount for said stage and repeat (b)(ii) to (b)(v) for said stage for the gaming machines at least once.

8. The method of claim 7, which includes, for said stage of the group game, causing the central controller to operate with the plurality of gaming machines to repeat (b)(ii) to (b)(v) up to a maximum quantity of times, said maximum quantity being at least two.

9. The method of claim 7, which includes causing the central controller to operate with the plurality of gaming machines to, for said stage of the group game, if the target quantity of the at least one designated selection has been picked, provide (b)(i) to (b)(v) for said other stage of the group game.

10. The method of claim 9, wherein a displayed initial award amount for said other stage of the group game is greater than the displayed initial award amount for said stage of the group game.

11. The method of claim 7, which includes causing the central controller to operate with the plurality of gaming machines to, for said stage of the group game, if the target quantity of the at least one designated selection has been picked, provide the displayed award amount by providing at least part of the displayed award amount to each player participating in the group game.

12. The method of claim 7, wherein an average expected total payback percentage of the group game is the same regardless of a number of players participating in the group game.

13. The method of claim 7, which is provided through a data network.

14. The method of claim 13, wherein the data network is an internet.

15. A non-transitory computer readable medium storing a plurality of instructions which, when executed by at least one processor, cause the at least one processor to:

(a) upon an occurrence of a triggering event in association with at least one wagered-on play of the primary game, provide a group game having a plurality of different stages; and (b) for one of the stages of the group game:

(i) cause at least one display device to display a plurality of different selections, the displayed selections including at least one designated selection;

(ii) cause the at least one display device to display an initial award amount for said stage;

(iii) for each of a plurality of different gaming machines, operate with at least one input device of said gaming machine to receive a pick of one of the displayed selections from a player of said gaming machine;

(iv) if a target quantity of each of the at least one designated selection has been picked, the target quantity being at least one:

(A) provide the displayed award amount, a credit balance of at least one of said gaming machines being increasable by the displayed award amount, said credit balance also being increasable via receipt by an acceptor of a physical item associated with a monetary value, said credit balance being decreasable via actuation of a cashout device to initiate a payout associated with the credit balance; and (B) if at least one of the stages of the group game has not been provided, provide another one of the stages of the group game; and (v) if the target quantity of each of the at least one designated selection has not yet been picked, regardless of whether the at least one designated selection has been picked, reduce the displayed award amount for said stage and repeat (b)(ii) to (b)(v) for said stage for the gaming machines at least once.

16. The non-transitory computer readable medium of claim 15, wherein the plurality of instructions, when executed by the at least one processor, cause the at least one processor to, for said stage of the group game, repeat (b)(ii) to (b)(v) up to a maximum quantity of times, said maximum quantity being at least two.

17. The non-transitory computer readable medium of claim 15, wherein the plurality of instructions, when executed by the at least one processor, cause the at least one processor to, for said stage of the group game, if the target quantity of the at least one designated selection has been picked, provide (b)(i) to (b)(v) for said other stage of the group game.

18. The non-transitory computer readable medium of claim 17, wherein a displayed initial award amount for said other stage of the group game is greater than the displayed initial award amount for said stage of the group game.

19. The non-transitory computer readable medium of claim 15, wherein the plurality of instructions, when executed by the at least one processor, cause the at least one processor to, for said stage of the group game, if the target quantity of the at least one designated selection has been picked, provide the displayed award amount by providing at least part of the displayed award amount to each player participating in the group game.

20. The non-transitory computer readable medium of claim 15, wherein an average expected total payback percentage of the group game is the same regardless of a number of players participating in the group game.

* * * * *